US011708649B2

(12) United States Patent
Abouraddy et al.

(10) Patent No.: US 11,708,649 B2
(45) Date of Patent: Jul. 25, 2023

(54) COLOR-CHANGING FABRIC HAVING PRINTED PATTERN

(71) Applicant: University of Central Florida Research Foundation, Inc., Orlando, FL (US)

(72) Inventors: Ayman Abouraddy, Orlando, FL (US); Joshua Kaufman, Orlando, FL (US); Felix Tan, Orlando, FL (US); Morgan Monroe, Orlando, FL (US)

(73) Assignee: UNIVERSITY OF CENTRAL FLORIDA RESEARCH FOUNDATION, INC., Orlando, FL (US)

( * ) Notice: Subject to any disclaimer, the term of this patent is extended or adjusted under 35 U.S.C. 154(b) by 290 days.

(21) Appl. No.: 16/880,802

(22) Filed: May 21, 2020

(65) Prior Publication Data

US 2021/0363669 A1 Nov. 25, 2021

(51) Int. Cl.

| | |
|---|---|
| ***D03D 15/54*** | (2021.01) |
| ***D03D 1/00*** | (2006.01) |
| ***A41D 31/04*** | (2019.01) |
| ***A41D 1/00*** | (2018.01) |
| ***D06B 19/00*** | (2006.01) |
| ***D03D 15/47*** | (2021.01) |
| *A41D 1/04* | (2006.01) |

(52) U.S. Cl.

CPC ..... *D03D 1/0088* (2013.01); *A41D 1/005* (2013.01); *A41D 31/04* (2019.02); *D03D 15/47* (2021.01); *D06B 19/0005* (2013.01); *A41D 1/04* (2013.01); *D10B 2401/16* (2013.01); *D10B 2401/18* (2013.01); *D10B 2501/04* (2013.01)

(58) Field of Classification Search

CPC ..... D03D 15/54

See application file for complete search history.

(56) References Cited

U.S. PATENT DOCUMENTS

| | | | |
|---|---|---|---|
| 2,936,482 | A | 5/1960 | Kilian |
| 2,989,798 | A | 6/1961 | Bannerman |

(Continued)

FOREIGN PATENT DOCUMENTS

| | | | |
|---|---|---|---|
| CN | 1898421 | A | 1/2007 |
| DE | 10 2009 052 848 | A1 | 5/2011 |

(Continued)

OTHER PUBLICATIONS

Foreign Action other than Search Reporton CN 201880081397.8 dated Dec. 1, 2021.

(Continued)

*Primary Examiner* — Andrew T Piziali

(74) *Attorney, Agent, or Firm* — Foley & Lardner LLP

(57) ABSTRACT

A color-changing product includes a fabric. The fabric includes a first layer and a second layer. The first layer is arranged using at least one fiber. The at least one fiber includes (a) an electrically conductive core and (b) a coating disposed around and along the electrically conductive core. The second layer is printed onto the first layer. The second layer includes a foreground thermochromic pigment that is selectively activatable by providing an electrical current to the electrically conductive core of the at least one fiber to change at least one of a foreground color or a pattern of the second layer.

20 Claims, 24 Drawing Sheets

(56) References Cited

U.S. PATENT DOCUMENTS

| | | | |
|---|---|---|---|
| 3,217,734 | A | 11/1965 | Fitzgerald |
| 4,059,949 | A | 11/1977 | Lee |
| 4,085,182 | A | 4/1978 | Kato |
| 4,851,282 | A | 7/1989 | Shimizu et al. |
| 5,110,998 | A | 5/1992 | Muschiatti |
| 5,753,381 | A | 5/1998 | Feldman et al. |
| 5,827,611 | A | 10/1998 | Forbes |
| 5,906,004 | A | 5/1999 | Lebby et al. |
| 6,069,435 | A | 5/2000 | Amey, Jr. et al. |
| 6,096,666 | A | 8/2000 | Jachimowicz et al. |
| 6,607,157 | B1 | 8/2003 | Duescher |
| 6,710,242 | B1 | 3/2004 | Iguro et al. |
| 7,164,820 | B2 | 1/2007 | Eves et al. |
| 9,182,561 | B2 | 11/2015 | Bauco |
| 11,365,493 | B2 | 6/2022 | Zhou et al. |
| 2001/0045677 | A1 | 11/2001 | Kang |
| 2002/0046795 | A1 | 4/2002 | Billieres |
| 2002/0090510 | A1 | 7/2002 | Ono et al. |
| 2002/0114598 | A1 | 8/2002 | Bodaghi |
| 2003/0194578 | A1 | 10/2003 | Tam et al. |
| 2003/0224155 | A1 | 12/2003 | Orth et al. |
| 2006/0000766 | A1 | 1/2006 | Ji |
| 2006/0081639 | A1 | 4/2006 | Lazaroff et al. |
| 2007/0195546 | A1 | 8/2007 | Den Toonder et al. |
| 2007/0273951 | A1 | 11/2007 | Ribi |
| 2008/0092599 | A1 | 4/2008 | Hazan et al. |
| 2008/0170982 | A1 | 7/2008 | Zhang et al. |
| 2008/0233379 | A1 | 9/2008 | O'Connor |
| 2009/0065969 | A1 | 3/2009 | Perera et al. |
| 2009/0085444 | A1 | 4/2009 | Alvarez Icaza Rivera et al. |
| 2009/0105796 | A1 | 4/2009 | Atanasoska et al. |
| 2009/0133922 | A1 | 5/2009 | Okazaki et al. |
| 2009/0260848 | A1 | 10/2009 | Perera et al. |
| 2009/0302237 | A1 | 12/2009 | Bortz et al. |
| 2010/0003496 | A1 | 1/2010 | Dias et al. |
| 2010/0029161 | A1 | 2/2010 | Pourdeyhimi |
| 2010/0089607 | A1 | 4/2010 | Nakamura et al. |
| 2010/0315755 | A1 | 12/2010 | Gavin |
| 2011/0109611 | A1 | 5/2011 | Nakamura |
| 2011/0217544 | A1 | 9/2011 | Young et al. |
| 2012/0077403 | A1 | 3/2012 | Gaillard et al. |
| 2012/0097194 | A1 | 4/2012 | Mcdaniel et al. |
| 2012/0148797 | A1* | 6/2012 | Tsai ..... F41H 3/00 428/137 |
| 2012/0211156 | A1* | 8/2012 | Harvey ..... A41D 31/04 156/277 |
| 2012/0231690 | A1 | 9/2012 | Pourdeyhimi et al. |
| 2013/0033378 | A1 | 2/2013 | Donovan et al. |
| 2014/0113813 | A1 | 4/2014 | Kwan |
| 2014/0170920 | A1 | 6/2014 | Manipatruni et al. |
| 2014/0329058 | A1 | 11/2014 | Lin |
| 2014/0366238 | A1 | 12/2014 | Owen et al. |
| 2015/0088027 | A1 | 3/2015 | Cranston et al. |
| 2015/0191607 | A1 | 7/2015 | Mcdaniel |
| 2015/0275404 | A1 | 10/2015 | Erlandsson et al. |
| 2016/0053169 | A1 | 2/2016 | Kunath et al. |
| 2016/0168759 | A1 | 6/2016 | Grassi et al. |
| 2016/0174650 | A1 | 6/2016 | Donovan et al. |
| 2016/0178454 | A1 | 6/2016 | Savaria et al. |
| 2016/0223878 | A1 | 8/2016 | Tran et al. |
| 2017/0029991 | A1 | 2/2017 | Chandrasekaran et al. |
| 2017/0058451 | A1 | 3/2017 | Smith et al. |
| 2018/0240396 | A1 | 8/2018 | Fontecchio et al. |
| 2018/0271180 | A1 | 9/2018 | Kim et al. |
| 2018/0271188 | A1 | 9/2018 | Matheny et al. |
| 2018/0364518 | A1 | 12/2018 | Paolini, Jr. et al. |
| 2019/0040562 | A1 | 2/2019 | Moon |
| 2019/0064623 | A1 | 2/2019 | Gillaspie et al. |
| 2019/0071799 | A1 | 3/2019 | Zhou |
| 2019/0078237 | A1 | 3/2019 | Jeong et al. |
| 2019/0112733 | A1* | 4/2019 | Abouraddy ..... D01D 5/32 |
| 2019/0153630 | A1 | 5/2019 | Zhou |
| 2020/0024774 | A1 | 1/2020 | Yasutomo et al. |
| 2020/0029899 | A1 | 1/2020 | Bogdanovich et al. |
| 2020/0063296 | A1 | 2/2020 | Ozden et al. |
| 2020/0103720 | A1 | 4/2020 | Anseth et al. |
| 2020/0283931 | A1 | 9/2020 | Abouraddy et al. |
| 2022/0372663 | A1 | 11/2022 | Ino |

FOREIGN PATENT DOCUMENTS

| | | | |
|---|---|---|---|
| EP | 1 221 500 | A1 | 7/2002 |
| FR | 2993888 | | 1/2014 |
| JP | 2826134 | B2 | 3/1991 |
| JP | H04-122620 | A | 4/1992 |
| JP | H11-195329 | A | 7/1999 |
| JP | 3110521 | B2 | 11/2000 |
| JP | H02-041415 | A | 2/2002 |
| JP | 2004-137614 | A | 5/2004 |
| JP | 2007-521420 | A | 8/2007 |
| JP | H09-059823 | A | 3/2009 |
| JP | 2010-522283 | A | 7/2010 |
| JP | H11-053969 | A | 3/2011 |
| JP | 2012-500865 | A | 1/2012 |
| JP | 2012-528253 | A | 11/2012 |
| JP | 2013-529504 | A | 7/2013 |
| KR | 20120017436 | | 2/2012 |
| WO | WO-97/27360 | A1 | 7/1997 |
| WO | WO-2005/096075 | A1 | 10/2005 |
| WO | WO-2006/123133 | A1 | 11/2006 |
| WO | WO-2014/020266 | A1 | 2/2014 |

OTHER PUBLICATIONS

Foreign Action other than Search Report on JP 2020-542537 dated Jan. 5, 2022.

International Search Report and Written Opinion, PCT/US2018/056323, University of Central Florida Research Foundation, Inc., 8 pages (dated Jan. 2, 2019).

Non-Final Office Action on U.S. Appl. No. 16/163,307 dated Aug. 22, 2022.

Teamlogo .com ("Custom Imprint and Embroidery"). Website: https ://web .archive org/web/20140701115135/https://teamlogo .com/inc/sdetail/988/991. Jul. 1, 2014. (Year: 2014).

PCT International Search Report and Written Opinion for International Application No. PCT/US2021/033211 dated Aug. 25, 2021, 11 pages.

PCT International Search Report and Written Opinion for International Application No. PCT/US2021/033212 dated Sep. 8, 2021, 9 pages.

PCT International Search Report and Written Opinion for International Application No. PCT/US2021/033216 dated Sep. 10, 2021, 12 pages.

European Search Report received for EP Application No. 18869173.7 dated Jun. 14, 2021, 8 pages.

International Preliminary Report on Patentability on PCT Appl. Ser. No. PCT/US2018/056323 dated Apr. 30, 2020 (6 pages).

Japanese Office Action and English Translation Received for application No. 2020-542537 dated Jun. 15, 2021, 6 pages.

KR Office Action on KR Appl. Ser. No. 10-2020-7013654 dated May 28, 2021 (11 pages).

Preliminary Rejection on KR Patent Application No. 10-2020-7013654 dated May 28, 2021 11 pages.

Laforgue et. al., "Multifunctional Resistive-Heating and Color-Changing Monofilaments Produced by a Single-Step Coaxial Melt-Spinning Process," ACS Appl. Mater. Interfaces 2020, 4 pages.

Li, Qiang et al., "Reduced graphene oxide functionalized stretchable and multicolor electrothermal chromatic fibers,", Journal of Materials Chemistry C, 2017, 6 pages.

* cited by examiner

COLOR-CHANGING FABRIC HAVING PRINTED PATTERN

BACKGROUND

Current fabric products having appearance and color-changing capabilities are passively controlled in response to environmental stimuli (e.g., sunlight, body heat, etc.). By way of example, photochromic dyes may be used in prints on clothing that change color in sunlight. By way of another example, thermochromic dyes may be used to passively change the color of a fabric through body heat and/or ambient heat. Thermochromic pigments change color in response to a thermal stimulus (e.g., as they change temperature, etc.). Thermochromic pigments may include liquid crystals, while other thermochromic pigments may use organic dyes (e.g., carbon-based dyes, etc.) known as leucodyes. Leucodyes are (i) optically transparent or have a particular color at a first temperature and (ii) become visible or change to a different color at a second temperature. Such a change is evident to an observer as the temperature rises or falls. Leucodyes are organic chemicals that change color when heat energy makes their molecules shift back and forth between two subtly differently structures, known as the leuco (colorless) and non-leuco (colored) forms. Thermochromic liquid crystals may shift color up and down the visible spectrum as they get hotter or colder, while leucodyes may be mixed in various ways to produce different kinds of color-changing effects at a wide range of temperatures.

SUMMARY

One embodiment relates to a color-changing product. The color-changing product includes a fabric. The fabric includes a first layer and a second layer. The first layer is arranged using at least one fiber. The at least one fiber includes (a) an electrically conductive core and (b) a coating disposed around and along the electrically conductive core. The second layer is printed onto the first layer. The second layer includes a foreground thermochromic pigment that is selectively activatable by providing an electrical current to the electrically conductive core of the at least one fiber to change at least one of a foreground color or a pattern of the second layer.

Another embodiment relates to a method for manufacturing a color-changing product. The method includes arranging a plurality of fibers to form a fabric, two or more of the plurality of fibers including (a) an electrically conductive core and (b) a coating disposed around and along the electrically conductive core; welding a connection bus along the fabric, the connection bus forming a weld between the electrically conductive cores of the two or more of the plurality of fibers; and printing a pattern onto the fabric, the pattern including a color-changing pigment configured to transition the pattern from a first state to a second state different than the first state in response to an electrical current being provided to the connection bus.

Still another embodiment relates to a camouflage product. The camouflage product include a fabric, a connection bus disposed along at least a portion of the fabric, a power source electrically connected to the connection bus, and a controller. The fabric includes a base layer and a pattern layer. The base layer is arranged using a plurality of color-changing fibers. Each of the plurality of color-changing fibers includes an electrically conductive core and a coating disposed around and along the electrically conductive core. The coating includes a polymeric material having a first color-changing pigment. The pattern layer is printed onto the base layer. The pattern layer includes a second thermochromic pigment and provides a camouflage pattern along the base layer. The connection bus forms a weld between the electrically conductive cores of the plurality of color-changing fibers. The connection bus includes a connection layer and a sealing layer. The connection layer is manufactured from a metallic material that electrically connects the electrically conductive cores. The sealing layer electrically isolates the weld from a surrounding environment. The controller is configured to selectively activate the power source to provide an electrical current to the connection bus and, thereby, the electrically conductive cores to activate the first color-changing pigment and the second color-changing pigment to transition the camouflage pattern from a first camouflage pattern to a second camouflage pattern different than the first camouflage pattern.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Figure 1:
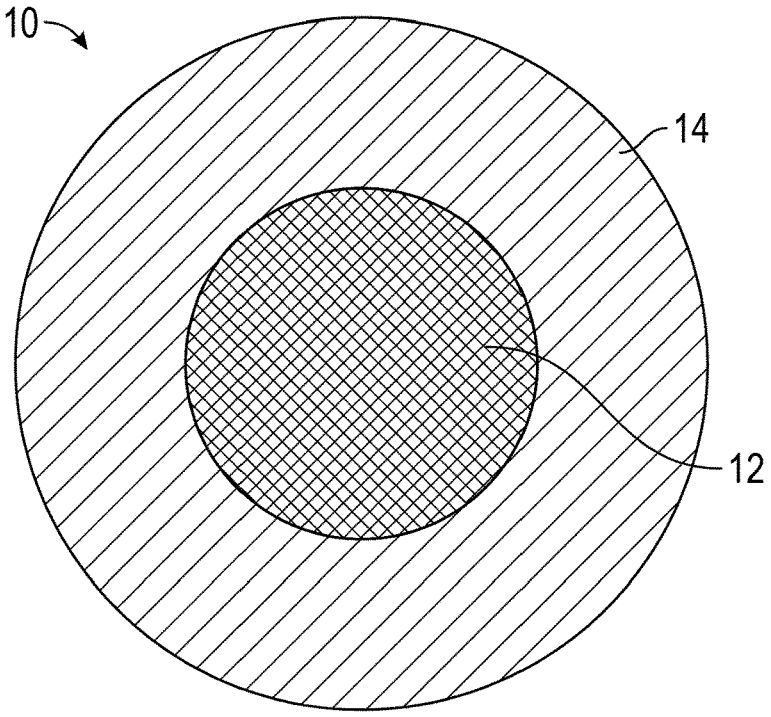
FIG. 1 is a cross-sectional view of a color-changing fiber, according to an exemplary embodiment.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Overview

The present disclosure is generally directed to the field of fabric technology and, more particularly, is directed to fibers, yarns, and fabrics having an on-demand (e.g., active, dynamic, selectively controllable, etc.) color-changing capability. According to an exemplary embodiment, a color-changing monofilament (e.g., a filament, a strand, a fiber, etc.), which is optionally formed (e.g., combined, twisted, braided, etc.) into a multifilament (e.g., yarn, thread, etc.), is configured to be either (i) incorporated into (e.g., stitched into, sewn into, embroidered into, integrated into, coupled to via a patch, etc.) an existing product or (ii) arranged (e.g., knit, woven, etc.) to form a new product. The color-changing monofilament includes at least one conductive core (e.g., an electrically conductive core, a thermally conductive core, a multi-core, etc.) and a color-changing coating disposed around and along the at least one conductive core. The color-changing coating includes one or more layers (e.g., one, two, three, four, etc.). Each of the one or more layers has one or has a respective thermochromic pigment. An electrical current provided to the conductive core, and thereby the temperature of the conductive core, is selectively controllable to actively and dynamically adjust the color of the color-changing coating. Advantageously, the color-changing monofilament of the present disclosure facilitates dynamically changing one or more visual characteristics of a fabric or product on-demand.

The color-changing monofilament or multifilament can be arranged (e.g., woven, knitted, etc.), with or without other monofilaments and/or multifilaments, to form a color-changing fabric. The color-changing monofilaments and/or multifilaments provide a base layer of the color-changing fabric having one or more background thermochromic pigments. A pattern layer may then be printed onto the base layer of the color-changing fabric. According to an exemplary embodiment, the pattern layer includes one or more foreground thermochromic pigments. Accordingly, the background thermochromic pigments and the foreground thermochromic pigments are selectively activatable by providing an electrical current to the conductive cores of the color-changing monofilaments to change the background color and the foreground color of the color-changing fabric.

In some embodiments, the base layer does not include the background thermochromic pigments. In some embodiments, a first portion of the base layer includes the background thermochromic pigment(s) and a second portion of the base layer does not include the background thermochromic pigment(s). In some embodiments, the first portion of the base layer includes a first background thermochromic pigment and the second portion of the base layer includes a second background thermochromic pigment different than the first background thermochromic pigment. In some embodiments, a first portion of the pattern layer includes a foreground thermochromic pigment and a second portion of the pattern layer does not include a foreground thermochromic pigment (e.g., includes a traditional, non-color-changing pigment; includes no pigment; etc.). In some embodiments, the first portion of the pattern layer includes a first foreground thermochromic pigment and the second portion of the pattern layer includes a second foreground thermochromic pigment that is different than the first foreground thermochromic pigment. In some embodiments, the pattern layer does not include the foreground thermochromic pigments. In some embodiments, a first portion of the pattern layer includes one or more first sections having one or more foreground thermochromic pigments, a second portion of the pattern layer includes one or more second sections having one or more non-color-changing pigments, and/or a third portion of the pattern layer includes one or more third sections that do not include a pigment (i.e., expose the base layer).

According to various exemplary embodiments, the color-changing fabric can be arranged (e.g., cut, sewn, etc.) to form (i) apparel such as headbands, wristbands, ties, bowties, shirts, jerseys, gloves, scarves, jackets, vests, pants, shorts, dresses, skirts, blouses, footwear/shoes, belts, hats, etc.; (ii) accessories such as purses, backpacks, luggage, wallets, jewelry, hair accessories, etc.; (iii) home goods, décor, and fixed installations such as curtains, window blinds, furniture and furniture accessories, table cloths, blankets, bed sheets, pillow cases, rugs, carpet, wallpaper, art/paintings, automotive interiors, etc.; (iv) outdoor applications and equipment such as tents, awnings, umbrellas, canopies, tarps, signage, etc.; and/or (v) still other suitable applications. Further applications may include camouflage (e.g., military camouflage, hunting camouflage, etc.), which may be dynamically (e.g., selectively, adaptively, etc.) changed to suit daytime, nighttime, season, desert locations, snow locations, forest locations, urban locations, and/or other environmental conditions.

Color-Changing Fiber

According to the various exemplary embodiments shown in FIGS. 1-7, a color-changing monofilament (e.g., a filament, a fiber, a strand, etc.), shown as color-changing fiber 10, includes a first core or conductive element, shown as conductive core 12, and a color-changing coating (e.g., sheath, cover, casing, etc.), shown as coating 14, disposed around and along the conductive core 12 such that the conductive core 12 is embedded within the coating 14. According to an exemplary embodiment, the conductive core 12 is manufactured from an electrically conductive material. In one embodiment, the conductive core 12 is manufactured from a metal or metal alloy. By way of example, the conductive core 12 may be manufactured from copper, nickel, aluminum, zinc, silver, gold, titanium, tungsten, molybdenum, chromium, platinum, palladium, nichrome, combinations thereof, and/or another suitable metal or metal alloy. In other embodiments, the conductive core 12 is manufactured from a non-metallic, electrically conductive material. By way of example, the conductive core 12 may be manufactured from a heavily doped semiconductor, a polymer doped with a conductive phase (e.g., an electrically conductive (conjugated) polymer, etc.), and/or carbon phases (e.g., graphite, graphene, carbon nanofibers, carbon nanowires, etc.). In some embodiments, the conductive core 12 includes electrically conductive contacts manufactured from a metallic material that is different than the material of the conductive core 12. In such embodiments, the conductive core 12 itself may or may not be conductive (e.g., a plastic core, any flexible core capable of being woven, etc.). According to an exemplary embodiment, the color-changing fibers 10 are flexible to permit weaving, knitting, and embroidery, and are durable as textile fibers such that the resultant end product is launderable (i.e., capable of being washed or laundered).

According to an exemplary embodiment, the coating 14 includes one or more layers of polymeric material (e.g., a polymer, a polymer composite, a polymer with polycrystalline material, Hytrel, cyclic olefin copolymer, polypropylene, nylon, polyester, etc.). At least one of the one or more layers of polymeric material includes a reversible thermochromic pigment combined (e.g., mixed, compounded, impregnated, etc.) therewith such that the respective layer changes color (i) in response to a temperature change thereof (e.g., the thermochromic pigment transitions from a first color to a second color when heated and transitions from the second color to the first color when cooled, etc.) and/or (ii) in response to an electrical current being provided to the conductive core 12. Generally, any suitable reversible thermochromic pigment composition may be used. For example, the thermochromic pigment may include a liquid crystal material and/or a leucodye. In one embodiment, the coating 14 includes a single layer of polymeric material. In another embodiment, the coating 14 includes a plurality of concentric layers of polymeric material. In some embodiments, each of the plurality of concentric layers of polymeric material includes a respective thermochromic pigment. In some embodiments, at least one of the plurality of layers of polymeric material does not include a thermochromic pigment, but rather the pigment of the at least one polymeric material is substantially fixed and does not change (due to temperature or electrical current). The material of the coating 14 may be appropriately chosen for its properties based on the specific application for the color-changing fiber 10.

In operation, an electrical current (e.g., provided by a power source such as a battery, a solar panel, a photovoltaic fiber, etc. for portable applications; provided by a power source such as battery, a solar panel, a photovoltaic fiber, a mains power supply, a standard wall socket, etc. for fixed installations or non-wearable applications; etc.) is passed through the conductive core 12. The resistance of the conductive core 12 to the electrical current causes the temperature of the conductive core 12 to elevate and thereby heat and activate the thermochromic pigment of the coating 14 to transition the color thereof from a first color to a second color (e.g., from a darker color to a lighter color, from one opaque color to a different opaque color, from opaque to transparent, or the like when a temperature transition threshold is reached). In some embodiments, the color-changing fiber 10 transitions from the first color to the second color in 10s or 100s of milliseconds (e.g., depending on the amount of power applied, etc.). In some embodiments, the transition may be extended to seconds or even minutes to reduce energy consumption.

The color-changing fiber 10 may remain continuously biased at the second color and thus retain the second color until the user decides to remove the applied power to enable transitioning the color of the coating 14 back to the first color. In some embodiments, removing the electrical current results in the coating 14 transitioning from the second color back to the first color. The coating 14 may remain at the second color for several seconds or minutes following the removal of the electrical current. The transition time from the second color back to the first color may depend on the environmental temperature (e.g., body temperature of the person, temperature of the ambient environment, etc.) and the temperature at which the thermochromic pigment activates/deactivates (e.g., the temperature transition threshold, etc.).

In some embodiments, removing the electrical current does not result in the coating 14 transitioning from the second color back to the first color. By way of example, the temperature at which the thermochromic pigment returns to the first color may be below the environmental temperature. In such a case, removing the electrical current does not result in the color transitioning from the second color back to the first color. Rather, in such embodiments, the color of the coating 14 may remain fixed until extra cooling is applied to the color-changing fiber 10 to change the color back to the first color. By way of another example, the coating 14 may include a respective thermochromic pigment that exhibits thermal hysteresis in its photo-thermal behavior. For example, once the respective thermochromic pigment reaches its temperature transition threshold, the color thereof transitions. However, the coating 14 may retain the new color even when the temperature drops below the temperature transition threshold. In such a case, the respective thermochromic pigment may need to be brought to a temperature lower than the temperature transition threshold to return to its original color (e.g., 5, 10, 15, etc. degrees lower than the temperature transition threshold, etc.). Such an asymmetric transition capability may advantageously assist in reducing the electrical power needed for maintaining the second color of the coating 14 following the transition from the original, first color of the coating 14 to the second color.

According to an exemplary embodiment, impregnating or otherwise mixing the material of the coating 14 with one or more thermochromic pigments facilitates controlling the optical properties of the resultant fabric or other end product that the color-changing fiber 10 is incorporated into. By way of example, changing the pigment concentration may yield a variety of dynamically controllable optical effects, such as transitioning from one solid color to another, transitioning from a solid color to a semi-transparent sheer effect, transitioning from a solid color to transparent or substantially transparent, etc. By way of another example, the selection of the type and concentration of the pigments within the material of the coating 14 may be specifically tailored to suit each individual application in order to provide a desired original color and transition color, optimize the transition temperature, provide a desired transition time, and/or minimize power consumption required to perform and/or maintain the transition.

The thermochromic pigment may transition the coating 14 from a first color to a second color at a first temperature transition threshold. The first temperature transition threshold may be dependent on (i) the respective polymer or polymer composite, (ii) the respective thermochromic pigment, and/or (iii) the concentration of the respective thermochromic pigment. The first temperature transition threshold may be designed to be at a temperature between about 0 degrees Celsius and about 70 degrees Celsius. The temperature transition threshold may be selected based on the intended application of the end product including the color-changing fibers 10. By way of example, the temperature transition threshold may be about 0 degrees Celsius (e.g., between −15 and 15 degrees Celsius, at 0 degrees Celsius, at −5 degrees Celsius, at 5 degrees Celsius, below 5 degrees Celsius, below 10 degrees Celsius, etc.) for a garment intended for an outdoor winter application. By way another of example, the temperature transition threshold may be about 27 degrees Celsius (e.g., between 15 and 30 degrees Celsius, etc.) for a garment intended for an indoor application. By way of yet another example, the temperature transition threshold may be about 38 degrees Celsius (e.g., between 30 and 45 degrees Celsius, etc.) for a garment intended for an outdoor summer application. By way of still another example, the temperature transition threshold may be about 49 degrees Celsius (e.g., between 45 and 50 degrees Celsius, etc.) for a garment intended for a desert environment application (e.g., military use, etc.). In some embodiments, the transition from the first color to the second color includes a spectrum of colors between the first color and the second color. By way of example, the thermochromic pigments may transition from the first color to the second color with one or more intermediate colors before completing the transition. In some embodiments, the second color is colorless or transparent such that the color of the conductive core 12 is exposed and visible or a second layer beneath become visible.

Figure 2:
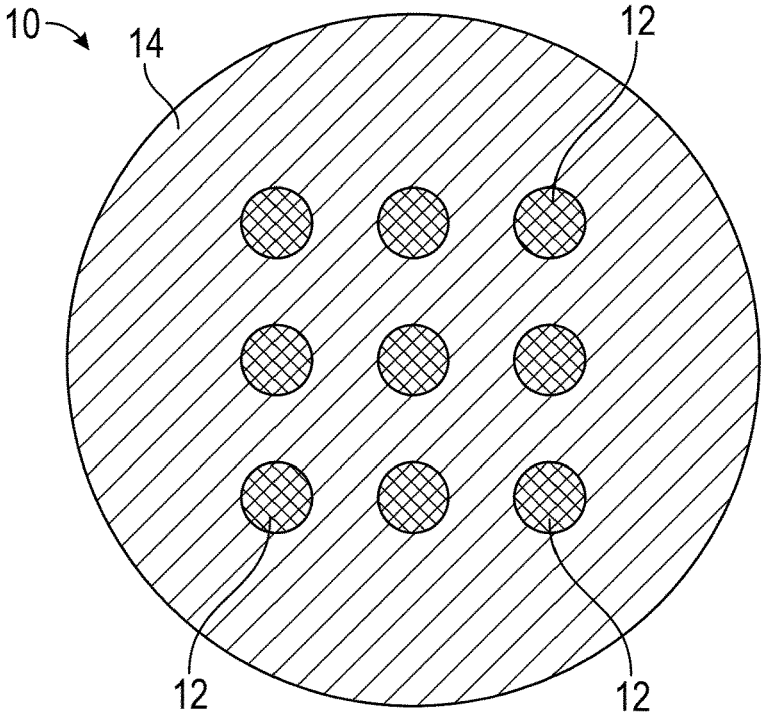
FIG. 2 is a cross-sectional view of a color-changing fiber, according to another exemplary embodiment.

As shown in FIG. 2, the color-changing fiber 10 includes a plurality of conductive cores 12 (e.g., a multi-core, etc.). According to the exemplary embodiment shown in FIG. 2, the color-changing fiber 10 includes nine separate conductive cores 12 disposed within the material of the coating 14 (i.e., the material is disposed around, along, and between the conductive cores 12). In other embodiments, the color-changing fiber 10 includes a different number of the conductive cores 12 (e.g., two, three, four, five, six, seven, eight, ten, etc. of the conductive cores 12).

According to the various exemplary embodiments shown in FIGS. 3-7, the color-changing fiber 10 includes a second core or reinforcing element, shown as reinforcement core 16, embedded within the coating 14 with the conductive core 12. In some embodiments, the reinforcement core 16 is a monofilament or fiber. In some embodiments, the reinforcement core 16 is a multifilament or yarn. According to an exemplary embodiment, the reinforcement core 16 is manufactured from a low denier, high tensile strength material having a greater tensile strength than the conductive core 12. By way of example, the reinforcement core 16 may increase the tensile strength of the color-changing fiber 10 by 50-500%. By way of example, the tensile strength of the color-changing fiber 10 may be able to withstand between a five pound tensile load and a thirty pound tensile load (e.g., depending on the type and/or number of the reinforcement cores 16 of the color-changing fiber 10). In one embodiment, the reinforcement core 16 has a tensile strength that can withstand up to a five pound tensile load. In another embodiment, the reinforcement core 16 has a tensile strength that can withstand up to a ten pound tensile load. In still another embodiment, the reinforcement core 16 has a tensile strength that can withstand up to a twenty pound tensile load. In other embodiments, the reinforcement core 16 has a tensile strength that can withstand up to a different tensile load (e.g., fifteen pounds, twenty-five pounds, thirty pounds, etc.). In some embodiments, the reinforcement core 16 is manufactured from a liquid crystal polymer fiber (e.g., a Kevlar-like liquid crystal aromatic polyester, etc.). By way of example, the liquid crystal polymer fiber may be or include Vectran. In some embodiments, the reinforcement core 16 is manufactured from an aramid fiber. By way of example, the aramid fiber may be or include Kevlar. In some embodiments, the reinforcement core 16 is manufactured from another material such as a low denier, high tensile strength nylon or polyester fiber/yarn, or fluorocarbon. According to an exemplary embodiment, the color-changing fibers 10 including the reinforcement core 16 are still flexible to permit weaving, knitting, and embroidery to provide a textile with increased durability.

Figure 3:
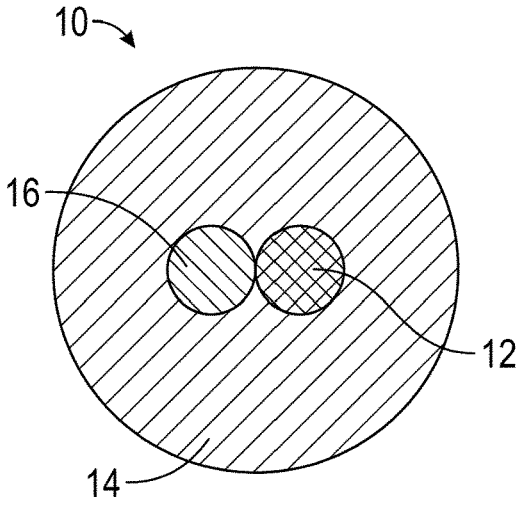
FIGS. 3-7 are various cross-sectional views of a core of a color-changing fiber including a reinforcement fiber, according to various exemplary embodiments.
Figure 4:
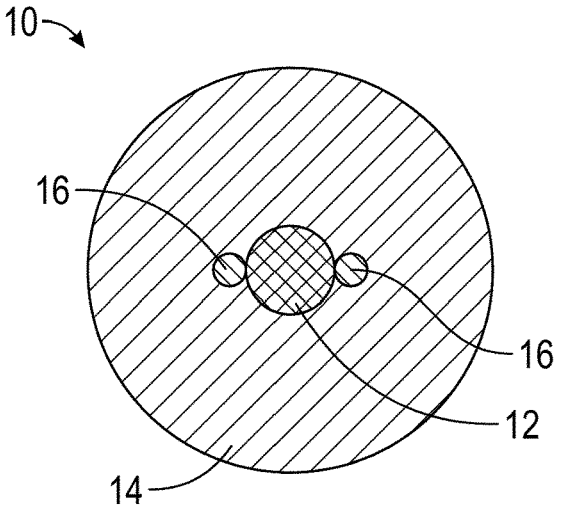
Figure 5:
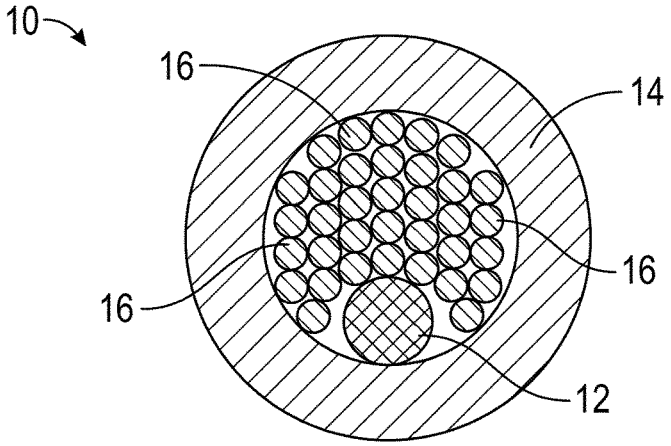
Figure 6:
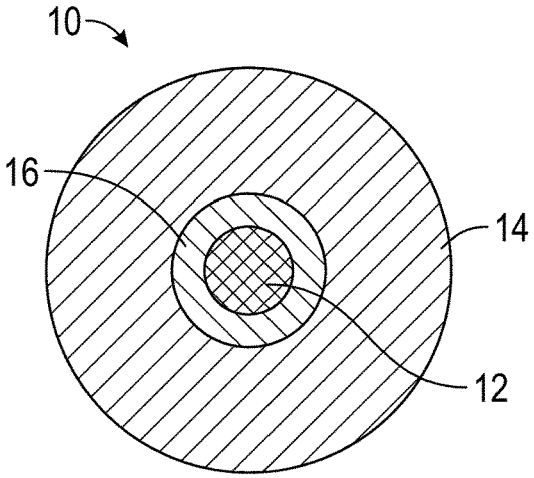
Figure 7:
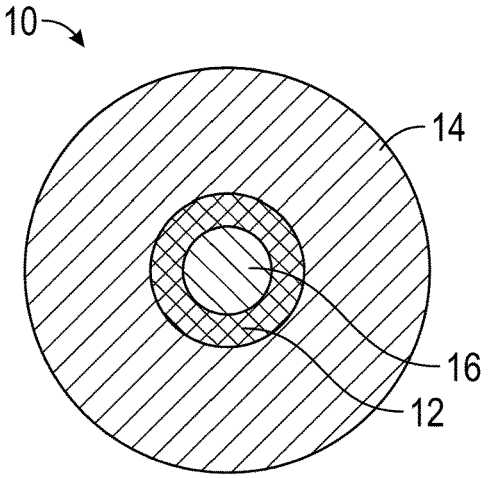

As shown in FIG. 3, the color-changing fiber 10 includes a single reinforcement core 16 disposed within the coating 14 and extending along the conductive core 12. In some embodiments, the reinforcement core 16 extends parallel and alongside the conductive core 12. In some embodiments, the reinforcement core 16 is spiraled around the conductive core 12. As shown in FIG. 4, the color-changing fiber 10 includes a plurality of the reinforcement cores 16 disposed within the coating 14, extending along the conductive core 12, and positioned variously around the periphery of the conductive core 12. While two reinforcement cores 16 are shown, more than two reinforcement cores 16 may be disposed within the coating 14 (e.g., three, four, five, etc.). In some embodiments, the multiple reinforcement cores 16 are used to provide a desired tensile strength of the color-changing fiber 10. Each reinforcement core 16 may have the same tensile strength (e.g., multiple fibers each having a five pound tensile strength, multiple fibers each having a ten pound tensile strength, etc.). Alternatively, the reinforcement cores 16 may have varying tensile strengths (e.g., one fiber with a five pound tensile strength and one fiber with a fifteen pound tensile strength, etc.). As shown in FIG. 5, the color-changing fiber 10 includes a plurality of the reinforcement cores 16 disposed within the coating 14, extending along the conductive core 12, and positioned along a portion of the periphery of the conductive core 12 in a multiple layer or staked arrangement. In some embodiments, a sufficient number of individual reinforcement cores 16 are included and arranged such that they form a reinforcement ring around the conductive core 12. As shown in FIG. 6, the reinforcement core 16 is a tubular element disposed within the coating 14 and the conductive core 12 is disposed within the reinforcement core 16. As shown in FIG. 7, the conductive core 12 is a tubular element disposed within the coating 14 and the reinforcement core 16 is disposed within the conductive core 12.

According to an exemplary embodiment, the color-changing fiber 10 has dimensions (e.g., diameter, etc.) suitable for weaving in an industrial loom. By way of example, the transverse dimensions (e.g., diameter, width, etc.) of the color-changing fiber 10 and/or a multifilament fiber (e.g., thread, yarn, etc.) formed therefrom may generally be less than 1 millimeter. In some embodiments, the transverse dimensions are less than 700 micrometers. In some embodiments, the transverse dimensions are less than 40 micrometers. In some embodiments, the transverse dimensions are in a range from 15 micrometers to 30 micrometers. The diameter of the conductive core(s) 12 may range between 1 micrometer and 500 micrometers. The diameter of the reinforcement core(s) 16 may range from 1 micrometer and 500 micrometers (e.g., 200-300 micrometers, 50 micrometers, 100 micrometers, less than 300 micrometers, less than 200 micrometers, 260-350 micrometer, etc.). The diameter of reinforcement core(s) 16 may be less than, greater than, or substantially the same as the conductive core 12 (e.g., dependent upon the desired tensile strength and overall diameter of the color-changing fiber 10, 100-150 micrometer, etc.). The internal cross-sectional structure of the color-changing fiber 10 may have many variations from, for example, a single conductive core with a cladding coating, a multi-conductive-core within a cladding coating, a single conductive core with concentric ring coating layers, a single conductive core with a multi-segment coating in the azimuthal direction, combinations thereof, all of the above with one or more reinforcement cores, etc. All such variations are described in greater detail in U.S. Patent Publication No. 2019/0112733, filed Oct. 17, 2018, which is incorporated herein by reference in its entirety. Further, while the color-changing fiber 10 is shown in FIGS. 1-7 to have a circular cross-sectional shape, in other embodiments, the color-changing fiber 10 has a different cross-sectional shape (e.g., square, triangular, rectangular, etc.). In such embodiments, the conductive core 12 and/or the reinforcement core 16 may have a circular cross-sectional shape or may have another shape that corresponds with the cross-sectional shape of the coating 14.

In some embodiments, the color-changing fiber 10 includes phosphor (e.g., within the coating 14, disposed between the conductive core 12 and/or the reinforcement core 16 and the coating 14, in an independent coating layer, etc.). The phosphor may facilitate providing a color-changing fiber 10 with a selectively controllable "glow-in-the-dark" effect. By way of example, if the coating 14 transitions to a transparent state from an opaque state, with the phosphor disposed underneath the coating, the phosphor may glow through the coating 14 when in the transparent state to provide a luminescent fiber. By way of another example, if the coating 14 includes phosphor, the phosphor may "glow" as an electrical current is provided to the color-changing fiber 10.

Figure 8:
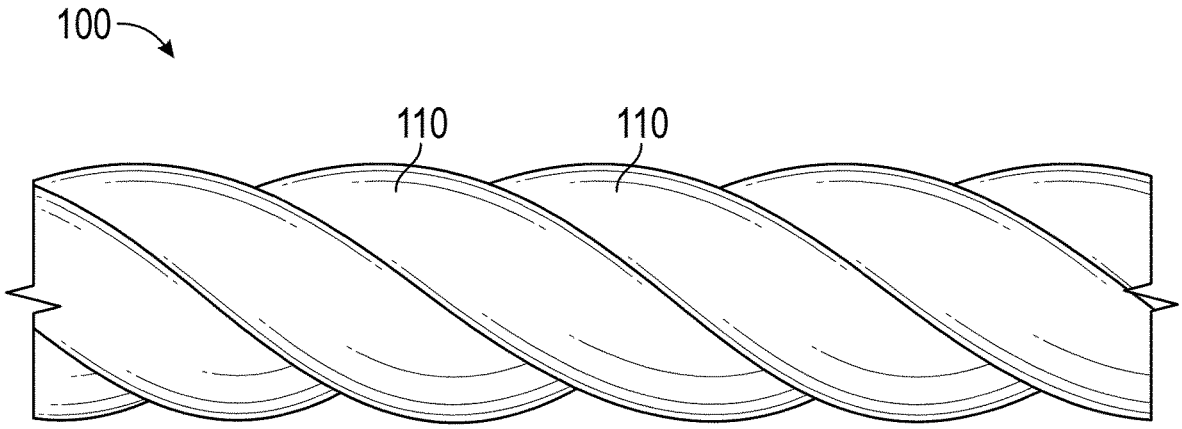
FIG. 8 is a side view of a color-changing yarn at least partially formed from one or more of the color-changing fibers of FIGS. 1-7, according to an exemplary embodiment.

In some embodiments, the color-changing fiber 10 is used to form fabric (e.g., in weaving or knitting processes, etc.) as a monofilament and/or is incorporated into an existing product or fabric (e.g., sewn into an existing fabric, embroidery, etc.) as a monofilament. In some embodiments, as shown in FIG. 8, the color-changing fiber 10 is formed into or incorporated into a multifilament fiber (e.g., yarn, thread, etc.), shown as color-changing yarn 100. The color-changing yarn 100 may be formed by twisting, braiding, or otherwise joining two or more fibers, shown as fibers 110. In some embodiments, the fibers 110 of the color-changing yarn 100 include one type of the color-changing fibers 10 of FIGS. 1-7. In other embodiments, the fibers 110 of the color-changing yarn 100 include a combination of two or more of the types of the color-changing fibers 10 of FIGS. 1-7. In still other embodiments, the fibers 110 of the color-changing yarn 100 include at least one of the color-changing fibers 10 of FIGS. 1-7, and at least one non-color-changing fiber. The non-color-changing fiber may be a (i) natural fiber including plant-based fiber (e.g., linen, etc.) and/or an animal-based fiber (e.g., wool, silk, etc.) and/or (ii) a synthetic fiber (e.g., rayon, acetate, nylon, acrylic, polyester, etc.).

In some embodiments, the non-color-changing fiber is a photovoltaic fiber. The photovoltaic fibers may be used to generate electrical energy from light energy to (i) charge or power a power source and/or (ii) directly provide an electrical current to the color-changing fibers 10 within the color-changing yarn 100 to facilitate the transition between the possible colors thereof. In some embodiments, the color-changing fiber 10 and/or the color-changing yarn 100 includes a glass core or another type of transparent core. In some embodiments, the color-changing fiber 10 includes sensors, the non-color-changing fiber includes sensors, and/or sensors are otherwise embedded within the color-changing yarn 100 (e.g., sensors to measure temperature, force, pressure, acceleration, moisture, etc.). By way of example, the sensors may be or include piezoelectric sensors that sense a depressive force or pressure (e.g., on the fabric that the color-changing yarn 100 is woven into, etc.). The piezoelectric sensors may send an electrical signal to a controller and the controller may take an appropriate action in response to the depression (e.g., provide electrical current to the color-changing fibers 10 to activate the thermochromic pigment to transition the color, etc.).

Fiber Manufacturing

Figure 9A:
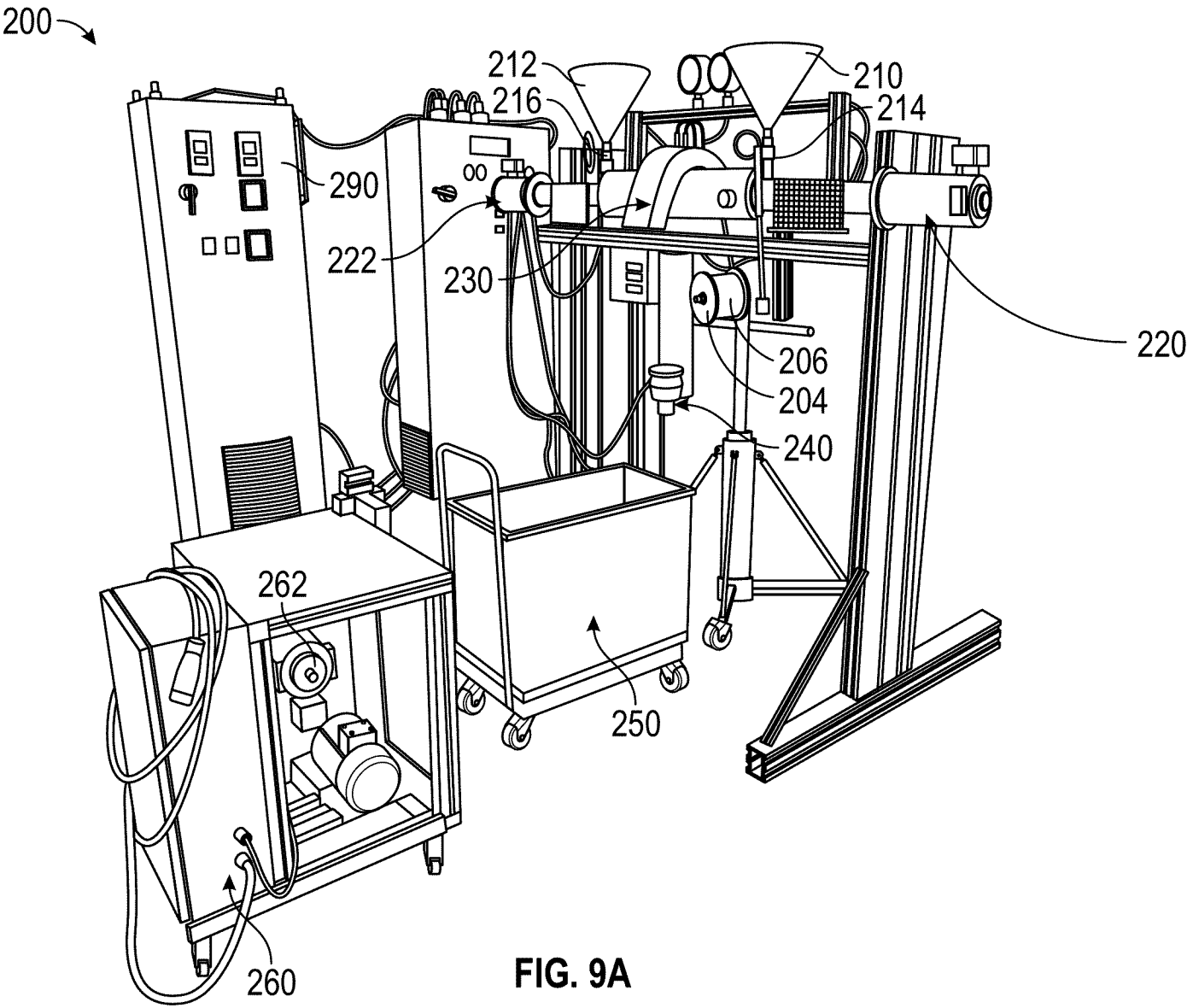
FIG. 9A is a perspective view of a fiber fabrication machine used to produce color-changing fibers, according to an exemplary embodiment.

According to the exemplary embodiment shown in FIGS. 9A-16, a machine, shown as fiber fabricator 200, is configured to manufacture the color-changing fiber 10. As shown in FIG. 9A, the fiber fabricator 200 includes a pair of hoppers, shown as first hopper 210 and second hopper 212, coupled to a pair of drivers, shown as first screw extruder 220 and second screw extruder 222, via conduits, shown as first feed tube 214 and second feed tube 216, respectively.

According to an exemplary embodiment, the first hopper 210 is configured to receive a first raw material of the coating 14 and the second hopper 212 is configured to receive a second raw material of the coating 14. By way of example, the first raw material may be a polymeric material such as thermoplastics, thermoplastic elastomers, polycrystalline polymers, and/or any other suitable material that softens sufficiently to traverse a fiber spinning system and then solidify upon cooling. The second raw material may be (i) a concentrate of the thermochromic pigment, (ii) a concentrate of the thermochromic pigment with added fillers or additives, and/or (iii) a concentrate of the thermochromic pigment and/or additives in a polymer host. The concentrate of the thermochromic pigment may come in the form of powder, pellets of any shape, slurry, ink, and/or another liquid. In other embodiments, the first hopper 210 and the second hopper 212 receive the same material (e.g., a thermochromic pigment and polymer mixture; see, e.g., FIGS. 10A-10E; etc.). In still other embodiments, the fiber fabricator 200 includes a different number of hoppers (e.g., three, four, eight, etc.) that each receive different material and/or facilitate increasing the capacity of material able to be loaded into the fiber fabricator 200.

According to the exemplary embodiment shown in FIG. 9A, the first screw extruder 220 is configured to receive the first raw material through the first feed tube 214 and the second screw extruder 222 is configured to receive the second raw material from the second hopper 212 through the second feed tube 216. In other embodiments, the fiber fabricator 200 does not include the second hopper 212, the second feed tube 216, or the second screw extruder 222, but rather the fiber fabricator 200 is configured to receive a premixed mixture or compound of the first raw material and the second raw material. Therefore, (i) the concentrate of the pigment may be pre-mixed uniformly with virgin polymer pellets (e.g., of thermoplastics, thermoplastic elastomers, polycrystalline polymers, etc.) and fed into the first screw extruder 220, (ii) the concentrate of the pigment may be pre-compounded with the virgin polymer pellets and fed into the first screw extruder 220, and/or (iii) the virgin polymer and the concentrate of the pigment may be kept separate and fed into the first screw extruder 220 and the second screw extruder 222 separately to be combined by a spinneret in a prescribed ratio to produce the desired color change for the color-changing fiber 10.

As shown in FIGS. 10A-10E, example raw materials 202 include (a) a concentrate of the thermochromic pigment in the form of a powder, (b) a concentrate of the thermochromic pigment in the form of a powder compounded with a host virgin polymer, (c) a concentrate of the thermochromic pigment in the form of pellets dispersed in a host resin with additives and fillers, (d) the pellets from (c) mixed with virgin polymer pellets, and (e) the pellets from (c) alongside virgin polymer pellets that may be separately introduced into the fiber fabricator 200.

As shown in FIG. 9A, the fiber fabricator 200 includes a pump, shown as melt pump 230, coupled to the first screw extruder 220 and the second screw extruder 222. According to an exemplary embodiment, the first screw extruder 220 and the second screw extruder 222 include heating elements that soften or melt the first raw material and/or the second raw material, respectively, which the first screw extruder 220 and the second screw extruder 222 drive into the melt pump 230. According to an exemplary embodiment, the processing temperature of the first raw material and the second raw material (e.g., the raw materials 202, etc.) within the first screw extruder 220 and the second screw extruder 222 is below a degradation temperature of the thermochromic pigment to avoid the destruction of the thermochromic pigment.

Figure 11:
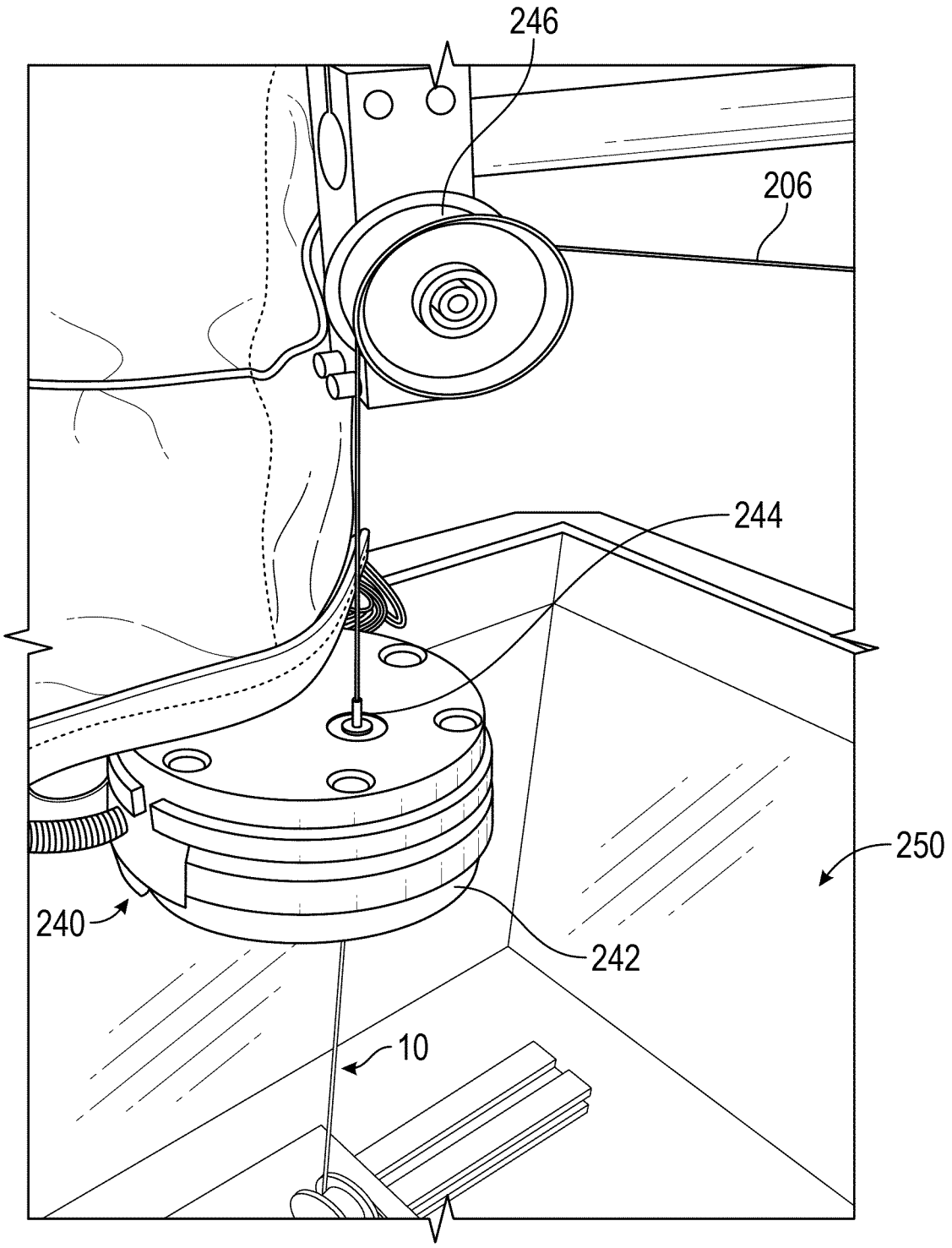
FIG. 11 is a detailed view of a spinneret of the fiber fabrication machine of FIG. 9A, according to an exemplary embodiment.

As shown in FIGS. 9A and 11, the fiber fabricator 200 includes a fiber coater, shown as spinneret 240, coupled to the melt pump 230. According to an exemplary embodiment, the melt pump 230 is configured to regulate the volume of the softened and/or melted material that is metered into the spinneret 240. As shown in FIG. 11, the spinneret includes a body, shown as housing 242, and a nozzle, shown as hollow needle 244, extending from the housing 242. As shown in FIG. 9A, the fiber fabricator 200 includes a first wire payoff attachment including a first spool, shown as wire spool 204, having a length of first prefabricated wire (e.g., wire for the conductive core 12), shown as wire 206, wound therearound. In some embodiments, the fiber fabricator 200 includes a second wire payoff attachment including a second spool having a length of second prefabricated wire (e.g., wire for the reinforcement core 16) wound therearound.

Figure 9B:
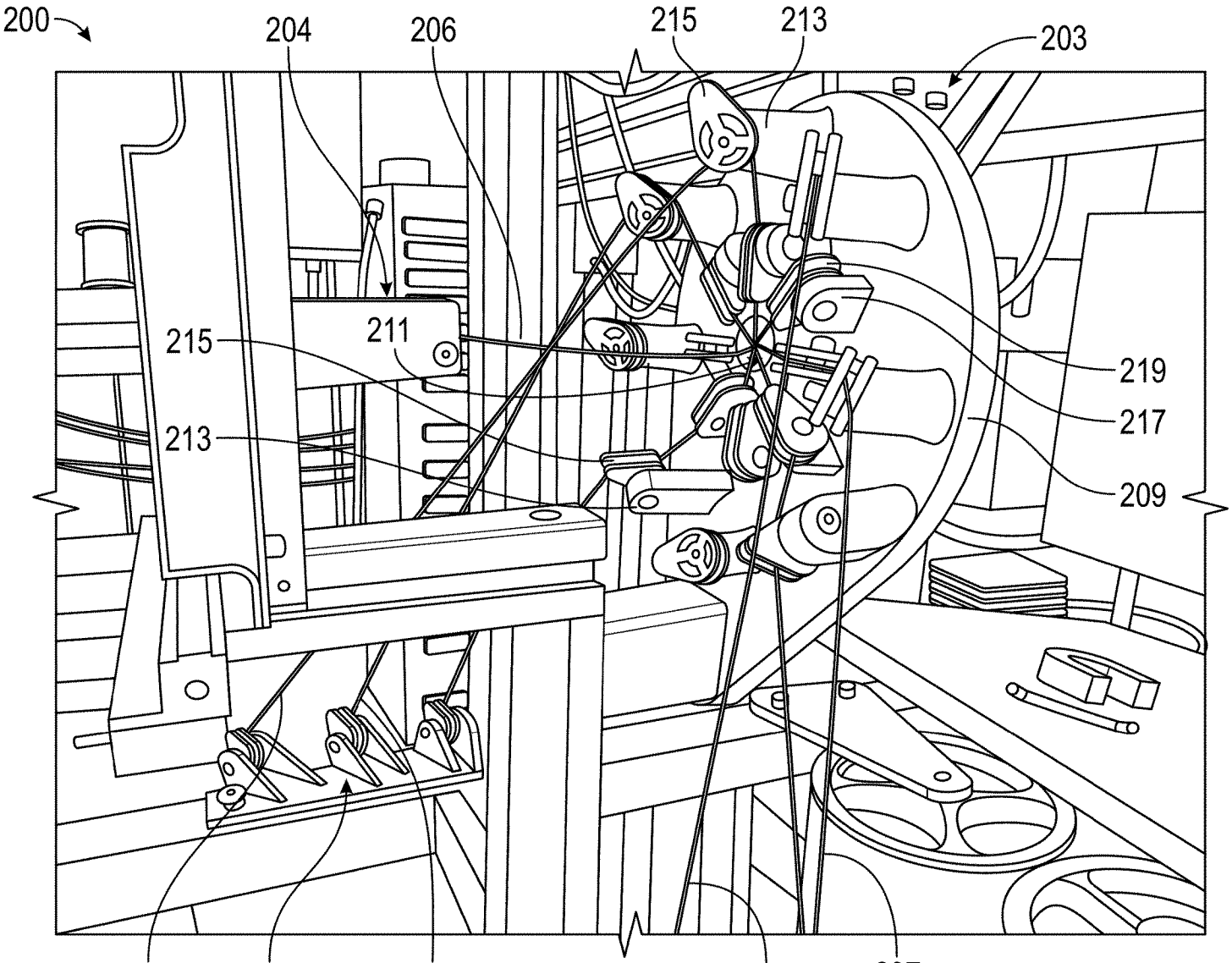
FIG. 9B is a perspective view of a wire dispensing apparatus of the fiber fabrication machine of FIG. 9A, according to an exemplary embodiment.
Figure 10A:
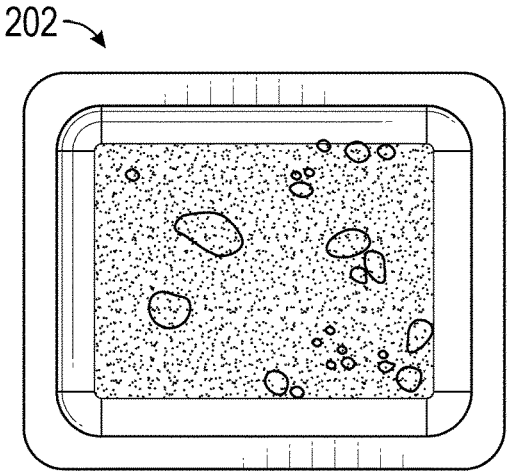
FIGS. 10A-10E are various raw materials that may be used by the fiber fabrication machine of FIG. 9A to form a coating of the color-changing fiber, according to an exemplary embodiment.
Figure 10B:
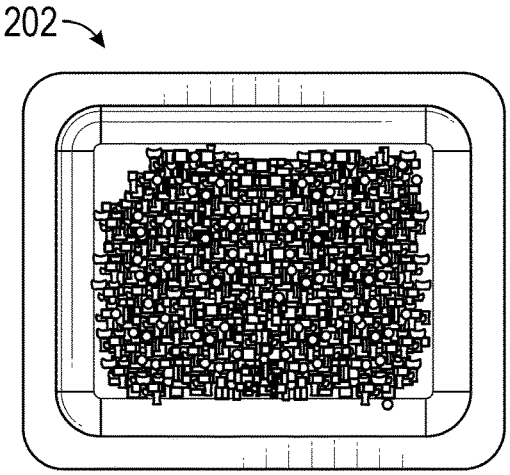
Figure 10C:
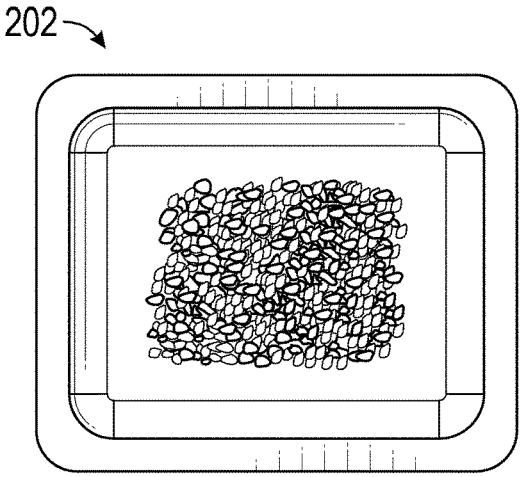
Figure 10D:
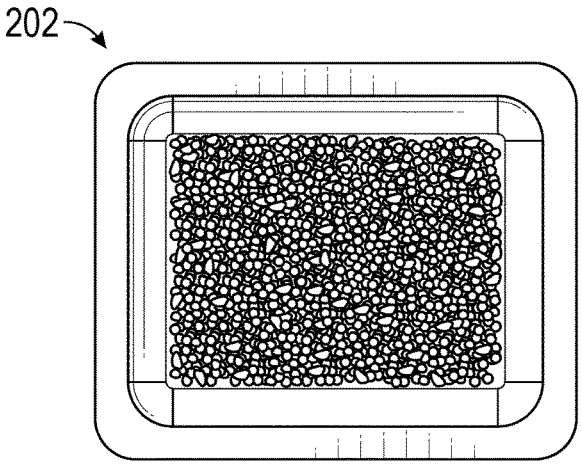
Figure 10E:
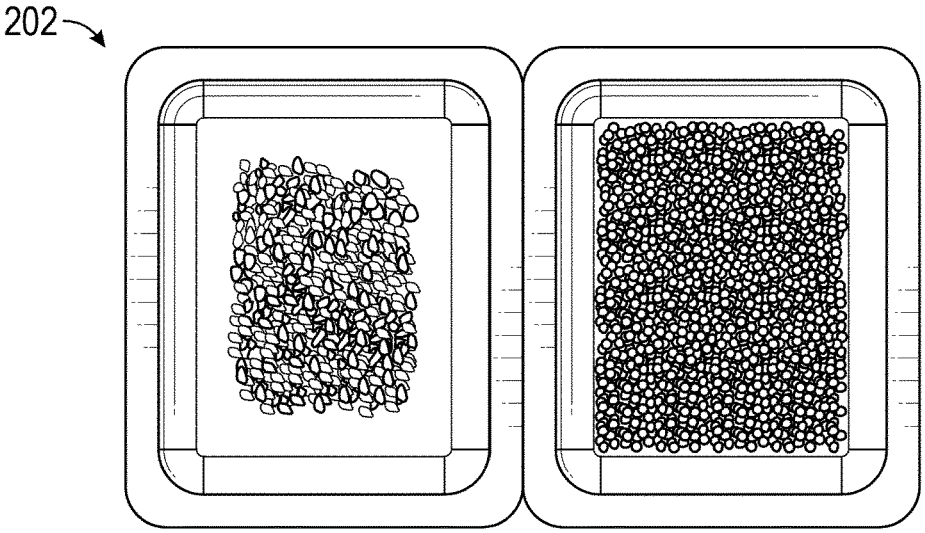

In some embodiments, as shown in FIG. 9B, the fiber fabricator 200 includes a wire dispensing apparatus, shown as wire payoff apparatus 203, configured to dispense a plurality of individual wires simultaneously (e.g., a plurality wires for a plurality of reinforcement cores 16, a first wire for the conductive core 12 and one or more second wires for one or more reinforcement cores 16, etc.). As shown in FIG. 9B, the wire payoff apparatus 203 includes (i) a first wire payoff attachment including the wire spool 204 having the wire 206 and (ii) a plurality of second wire payoff attachments including a plurality of second spools, shown as wire spools 205, having a length of second prefabricated wire (e.g., wire for the reinforcement cores 16), shown as wire 207, wound therearound. In some embodiments, the wire payoff apparatus 203 does not include the wire spool 204 such that the wire payoff apparatus 203 only provides/combines a plurality of the wires 207. In some embodiments, the wire payoff apparatus 203 only includes one of the wire spools 205 such that only one wire 207 is provided/combined with the wire 206.

As shown in FIG. 9B, the wire payoff apparatus 203 includes a base, shown as dispensing base 209, defining an aperture, shown as through-hole 211, positioned at the center of the dispensing base 209. The dispensing base 209 includes (i) a first plurality of mounts, shown as outer mounts 213, positioned/spaced around an outer periphery of the dispensing base 209 and (ii) a second plurality of mounts, shown as inner mounts 217, spaced radially inward from the outer mounts 213 and positioned around the through-hole 211. According to an exemplary embodiment, each of the inner mounts 217 is aligned with a respective one of the outer mounts 213. As shown in FIG. 9B, (i) each of the outer mounts 213 includes a first guide, shown as outer eyelet 215, that receives either the wire 206 from the wire spool 204 or one of the wires 207 from one of the wire spools 205 and (ii) each of the inner mounts 217 include a second guide, shown as inner eyelet 217, that receives the wire 206 or the wire 207 from the outer eyelet 215 associated therewith. The inner eyelets 217 direct the wire 206 and/or one or more of the wires 207 through the through-hole 211 to be provided together to the next component (e.g., a pulley, a needle, etc.) of the fiber fabricator 200.

As shown in FIG. 11, the fiber fabricator 200 includes a first pulley, shown as pulley 246, positioned to receive the wire 206 from the wire spool 204 and guide the wire 206 to the hollow needle 244 and into the housing 242 of the spinneret 240. In some embodiments, the pulley 246 receives the wire 206 and/or one or more of the wires 207 from the wire payoff apparatus 203. In some embodiments, the fiber fabricator 200 does not include the pulley 246, but rather the wire payoff apparatus 203 provides the wire 206 and/or the one or more of the wires 207 directly to the spinneret 240. The spinneret 240 is configured to coat the wire 206 and/or the one or more of the wires 207 with the material provided by the melt pump 230, which collapses onto the wire 206 and/or the one or more of the wires 207 to form the color-changing fiber 10 where the wire 206 functions as the conductive core 12, the one or more wires 207 function as one or more reinforcement cores 16, and the material functions as the coating 14. The color-changing fiber 10 is drawn out of or extruded from the housing 242 at a desired diameter by manipulating the amount of material provided by the melt pump 230 to the spinneret 240 and/or the speed of the wire 206 passing through the spinneret 240. In embodiments where the color-changing fiber 10 includes the reinforcement core 16, the material for the reinforcement core 16, e.g., the second prefabricated wire, may be received by the pulley 246 or a second pulley and guided with the wire 206 to the hollow needle 244 and into the housing 242 of the spinneret 240. The spinneret 240 is configured to coat both the wire 206 and the second prefabricated wire with the material provided by the melt pump 230, which collapses thereon to form a reinforced color-changing fiber 10.

Figure 12:
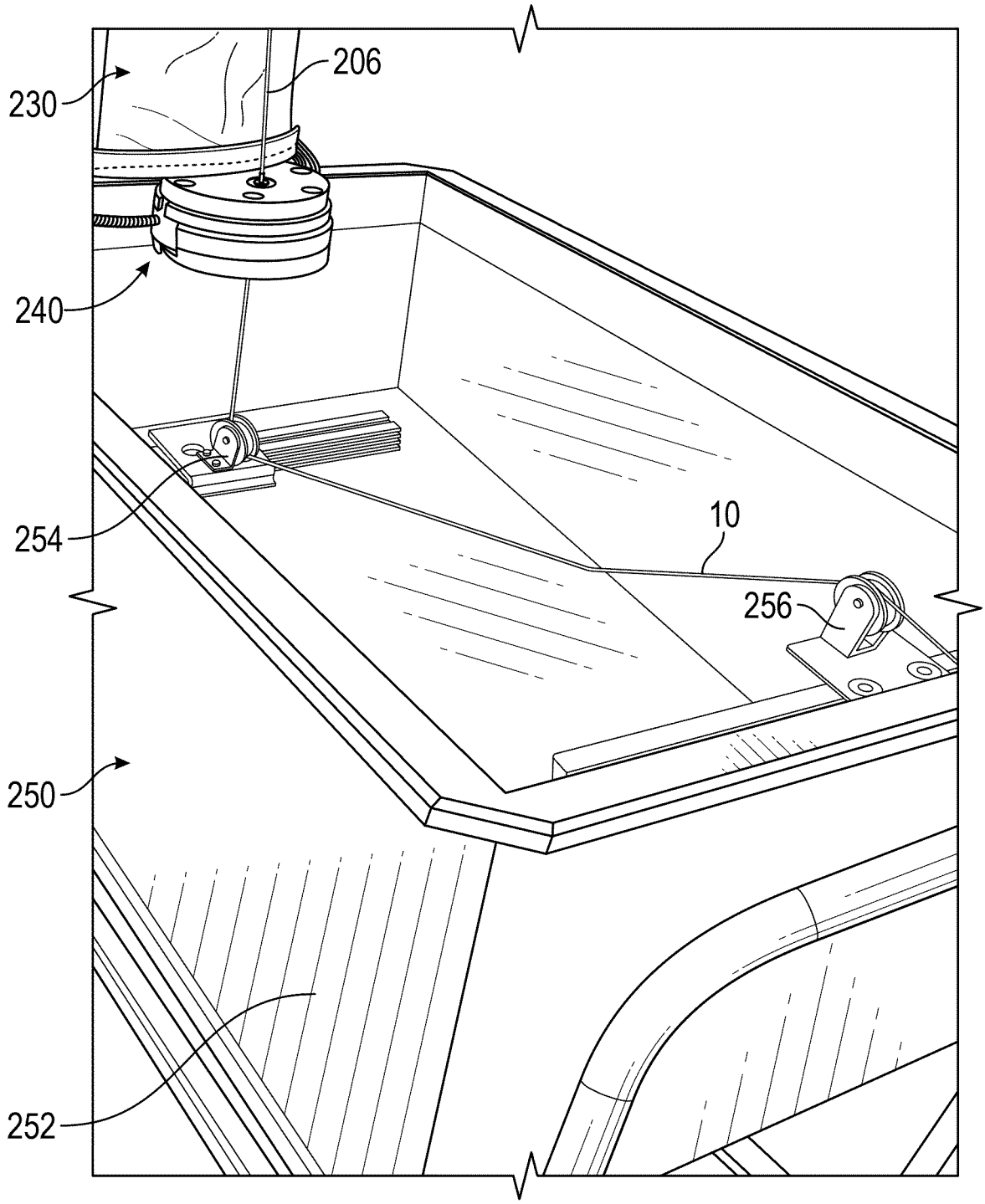
FIG. 12 is a detailed view of a quench assembly of the fiber fabrication machine of FIG. 9A, according to an exemplary embodiment.

The newly formed color-changing fiber 10 may then be quenched to solidify and prevent deformation of the coating 14 around the wire 206. As shown in FIGS. 9A, 11, and 12, the fiber fabricator 200 includes a quenching assembly, shown as water quench 250. As shown in FIG. 12, the water quench 250 includes a fluid container, shown as tub 252, that holds a volume of fluid such as water (or other suitable fluid). The water quench 250 further includes a second pulley, shown as pulley 254, positioned at the bottom of the tub 252, submerged in the fluid, and proximate a first end of the tub 252, and a third pulley, shown as pulley 256, positioned along a top edge of the tub 252 at an opposing, second end of the tub 252. The pulley 254 is positioned to receive the color-changing fiber 10 from the spinneret 240 and guide the color-changing fiber 10 through the fluid in the tub 252 to the pulley 256. In other embodiments, the coating 14 of the color-changing fiber 10 is quenched via air blade quenching or quenching in the ambient air environment.

Figure 13:
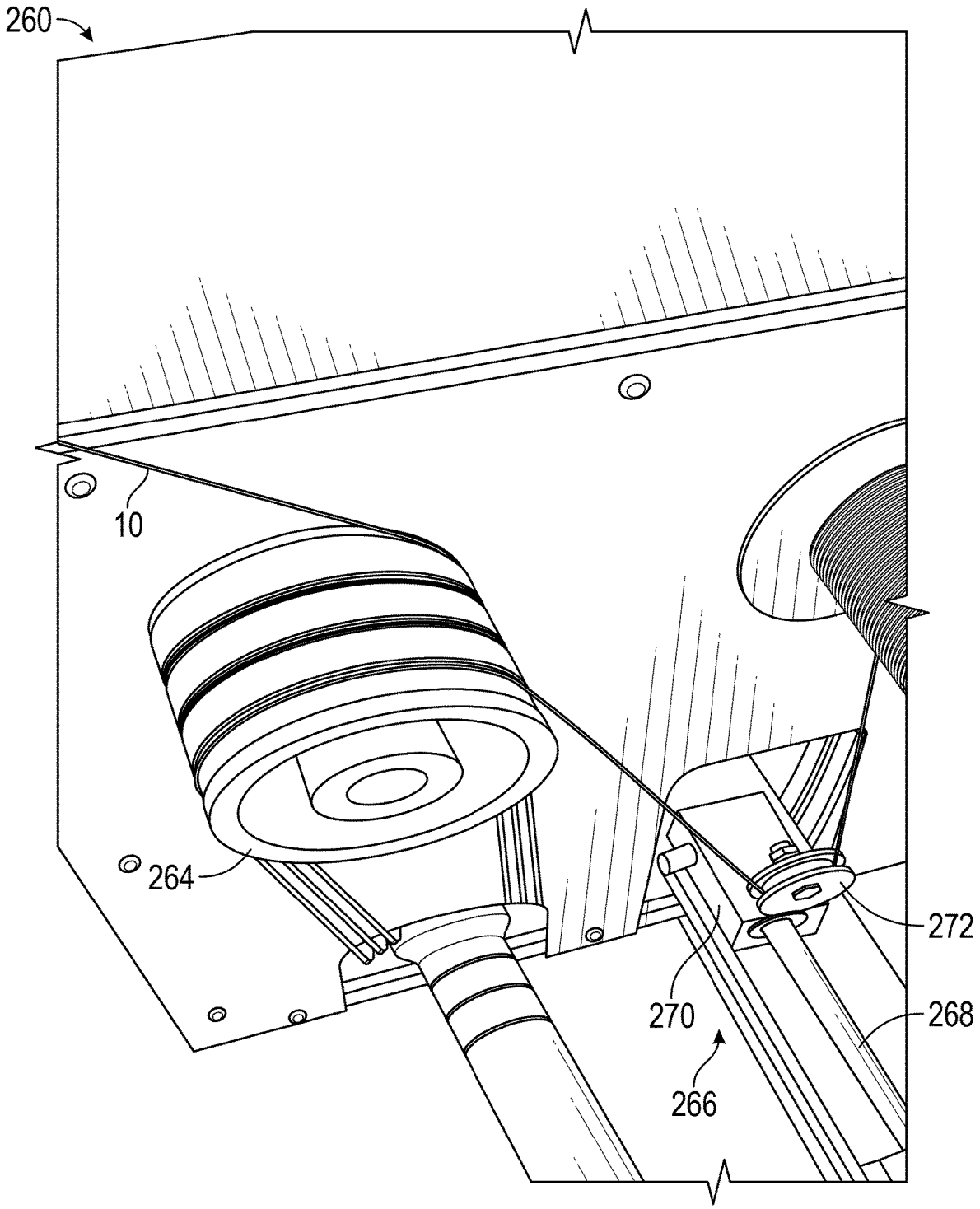
FIGS. 13 and 14 are detailed views of a winder assembly of the fiber fabrication machine of FIG. 9A, according to an exemplary embodiment.
Figure 14:
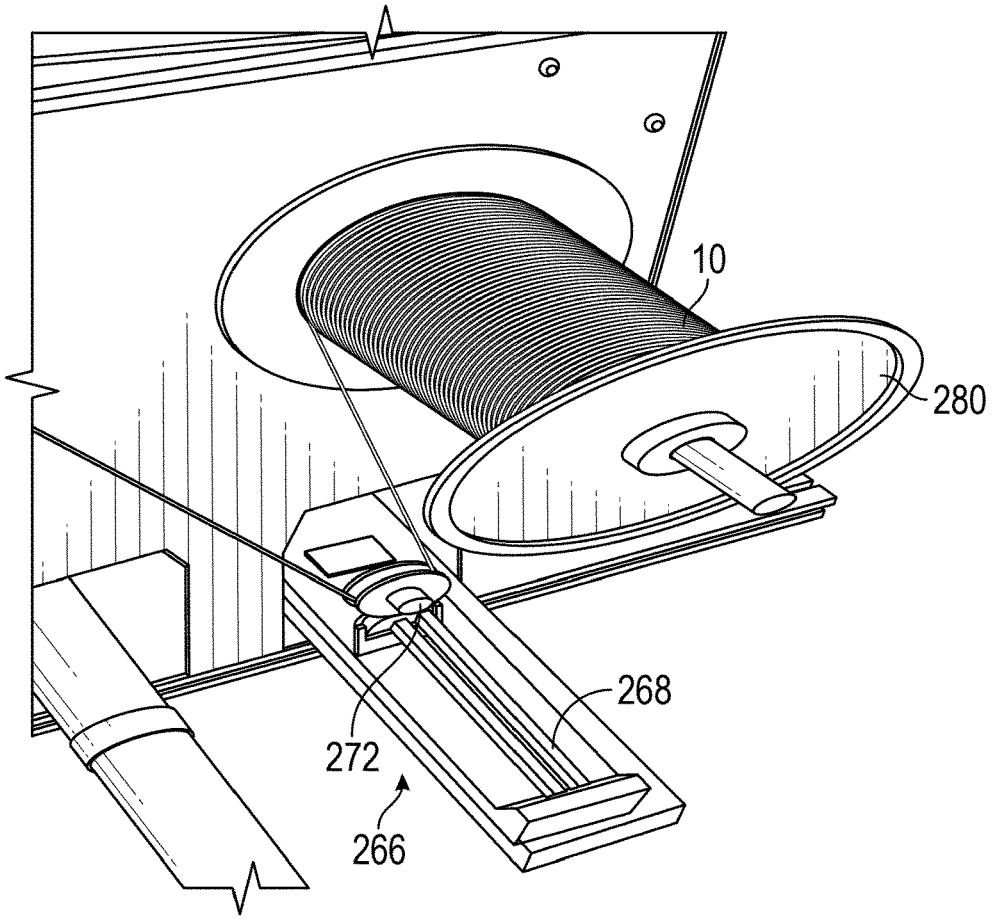

As shown in FIGS. 9A and 13, the fiber fabricator 200 includes a winding assembly, shown as winder 260. The winder 260 includes a motor, shown as drive motor 262, a fourth pulley, shown as godet roll 264, coupled to and driven by the drive motor 262, a traverse assembly, shown as traverse 266, and a take-up roll, shown as fiber spool 280. The traverse 266 includes a guide, shown as track 268, a slide, shown as slide 270, slidably coupled to the track 268, and a fifth pulley, shown as pulley 272, coupled to the slide 270. The godet roll 264 receives the color-changing fiber 10 from the pulley 256 of the water quench 250 and provides the color-changing fiber 10 to the pulley 272 of the traverse 266. The pulley 272 then guides the color-changing fiber 10 to the fiber spool 280. According to an exemplary embodiment, the slide 270 is configured to translate back and forth along the track 268 as the color-changing fiber 10 accumulates on the fiber spool 280 to evenly distribute the color-changing fiber 10 onto the fiber spool 280. The fiber spool 280 may be driven by a corresponding motor (e.g., at a speed based on the speed of the godet roll 264, etc.).

As shown in FIG. 9A, the fiber fabricator 200 includes a control system, shown as controller 290. The controller 290 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components. According to an exemplary embodiment, the controller 290 includes a processing circuit having a processor and a memory. The processing circuit may include an ASIC, one or more FPGAs, a DSP, circuits containing one or more processing components, circuitry for supporting a microprocessor, a group of processing components, or other suitable electronic processing components. In some embodiments, the processor is configured to execute computer code stored in the memory to facilitate the activities described herein. The memory may be any volatile or non-volatile computer-readable storage medium capable of storing data or computer code relating to the activities described herein. According to an exemplary embodiment, the memory includes computer code modules (e.g., executable code, object code, source code, script code, machine code, etc.) configured for execution by the processor.

According to an exemplary embodiment, the controller 290 is configured to control operation of the first screw extruder 220, the second screw extruder 222, the melt pump 230, the spinneret 240, the drive motor 262, and/or the traverse 266. By way of example, the controller 290 may control the speed of the wire 206 through the fiber fabricator 200 (e.g., by controlling the speed of the drive motor 262, etc.), the thickness of the coating 14 disposed onto the wire 206 (e.g., by controlling the flow of the melted coating provided by the melt pump 230, the speed of the drive motor 262, etc.), the temperature of the heating elements in the first screw extruder 220 and the second screw extruder 222, and/or the speed at which the first screw extruder 220 and the second screw extruder 222 are driven.

It should be understood that the description of the fiber fabricator 200 in relation to FIGS. 9A-15 is just one possible implementation of a machine that may be used to manufacture the color-changing fibers 10 and should not be considered as limiting. In other implementations, the fiber fabricator 200 may include different or variations of components, additional components, fewer components, etc. By way of example, the fiber fabricator 200 may include more hoppers (e.g., three, four, five, etc. hoppers). By way of another example, the fiber coater, the quench assembly, and/or the winder may be different than or a variation of the spinneret 240, the water quench 250, and/or the winder 260 disclosed herein.

Increased production is possible by adjusting the fiber fabricator 200 to include multiple spinnerets 240 with an equal number of winders 260. More complex monofilament structures may be produced through the use of distribution plates. The distribution plates may be placed directly above and/or within the spinneret 240, and through carefully designed internal channels, combine raw materials from different screw extruders to produce the desired structure. By way of example, the distribution plates may guide softened polymer in such a way as to create a desired cross-sectional pattern onto the conductive core 12. These structures may enable the production of the color-changing fiber 10 having multiple different thermochromic pigments segregated into each a plurality of segments within the cross-sectional structure. Color-changing fibers 10 with multi-layer coatings may be produced by passing the color-changing fiber 10 through the fiber fabricator 200 or a different fiber fabricator 200 one or more additional times to add additional layers to the coating 14. The melt-spinning process may be employed to produce fibers with highly complex, multi-component cross sections, which can enable optical effects that cannot be achieved by simply mixing the thermochromic pigments in polymer or braiding different threads into a yarn.

In some embodiments, a pixelated cross-section pattern of the coating 14 is generated using distribution plates. In such embodiments, the pixelated cross-sections may be arranged in such a way to form or generate an image in the resulting fabric.

According to another example embodiment, a second fabrication procedure involves the continuous injection of a conductive core material, rather than using a prefabricated wire such as the wire 206. The second fabrication procedure includes the use of raw materials. The raw materials for the coating 14 include those described above, in addition to a raw material or raw materials to form the conductive core 12 (i.e., no pre-existing wire is used). The raw materials to form the conductive core 12 may include (i) low-melting-temperature metals such as tin, indium, etc., (ii) low-melting-temperature metal alloys, (iii) a semiconductor material, (iv) a conductive polymer, or (v) combinations thereof. In some embodiments, the melt temperature of the raw materials for the conductive core 12 is less than the melt temperature of the raw materials for the coating 14.

Figure 16:
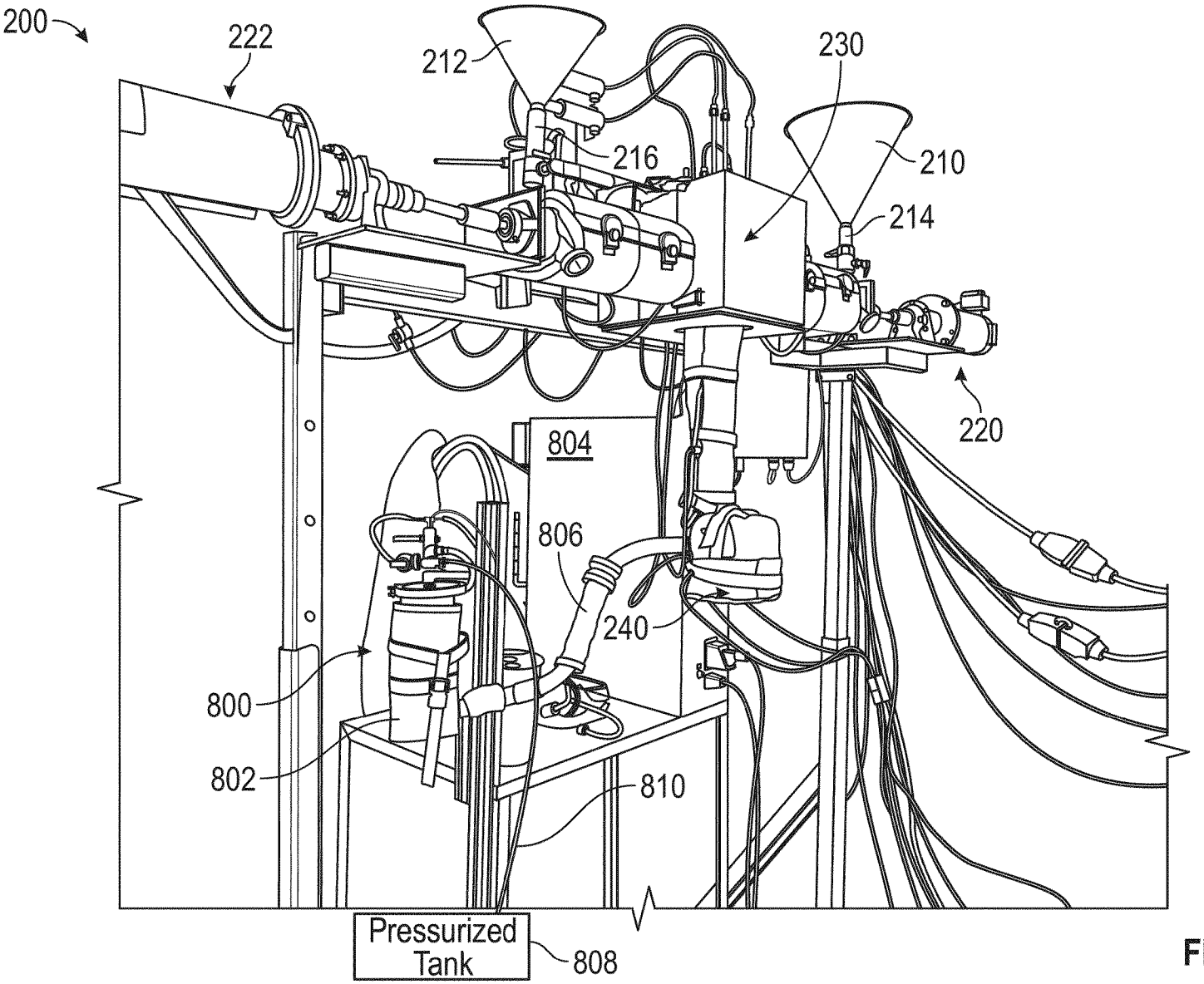
FIG. 16 is a perspective view of a fiber fabrication machine used to produce color-changing fibers, according to another exemplary embodiment.

As shown in FIG. 16, the fiber fabricator 200 does not include the wire spool 204 or use the wire 206, but, rather, the fiber fabricator 200 alternatively includes a liquid injection system, shown as conductive core injection system 800, that facilitates performing the second fabrication procedure. The conductive core injection system 800 includes a reservoir, shown as molten core reservoir 802, which may be heated to maintain molten core materials in a liquid/molten state; a heating unit, shown as heating cabinet 804, including heating elements that are configured to melt raw core materials, which are stored in the molten core reservoir 802; a first conduit, shown as heated hose 806, connecting the molten core reservoir 802 to the spinneret 240 to facilitate providing the molten core materials from the molten core reservoir 802 to the spinneret 240; a pressure source, shown as pressurized tank 808, configured to store pressurized gas (e.g., air, oxygen, nitrogen, etc.); and a second conduit, shown as gas line 810, extending between the molten core reservoir 802 and the pressurized tank 808 to facilitate providing the pressurized gas from the pressurized tank 808 to the molten core reservoir 802 to drive (e.g., force, push, etc.) the molten core materials through the heated hose 806 into the spinneret 240.

The second fabrication procedure may be performed as follows: (i) the raw materials for the coating 14 are fed into a hopper (e.g., the first hopper 210, the second hopper 212, etc.), (ii) the raw materials for the conductive core 12 are loaded into the conductive core injection system 800 (e.g., the heating cabinet 804, etc.), (iii) the raw materials for the conductive core 12 are melted and delivered via the conductive core injection system 800 to a specialized spinneret (e.g., a bicomponent melt extrusion pack, the spinneret 240, etc.), (iv) the raw materials for the coating 14 are melted and delivered via the first screw extruder 220, the second screw extruder 222, and/or the melt pump 230 to the specialized spinneret, (v) the specialized spinneret co-extrudes the conductive core 12 and the coating 14 into a core/cladding monofilament architecture (i.e., the color-changing fiber 10), and (vi) the color-changing fiber 10 is quenched and spooled.

According to an exemplary embodiment, the fiber fabrication processes disclosed herein provide flexibility with respect to the materials selection, structure, size, and even shape of each individual fiber. Exercising control over these degrees of freedom facilitates optimizing the heat transfer and thermal distribution over a fabric formed from the individual fibers. For example, materials with different thermal conductivities may heat up and cool down at different rates. The freedom to choose materials that either hold heat (i.e., allowing for less electrical energy to maintain the color change) or dissipate heat (i.e., allowing for quicker color change/return) facilitates tailoring the material to the application. Further, control over the size of the color-changing fiber 10 and the ratio of the diameter of the conductive core 12 and/or the reinforcement core 16 to the diameter of the coating 14 facilitates optimizing the largest material volume change per unit electrical energy. Furthermore, control over the diameter of the conductive core 12 (which is the typically a heavier metal component) and/or the reinforcement core 16 facilitates controlling the weight (i.e., how "heavy") of the resultant fabric. Such control therefore facilitates tailoring the fibers based on different application needs.

Figure 15:
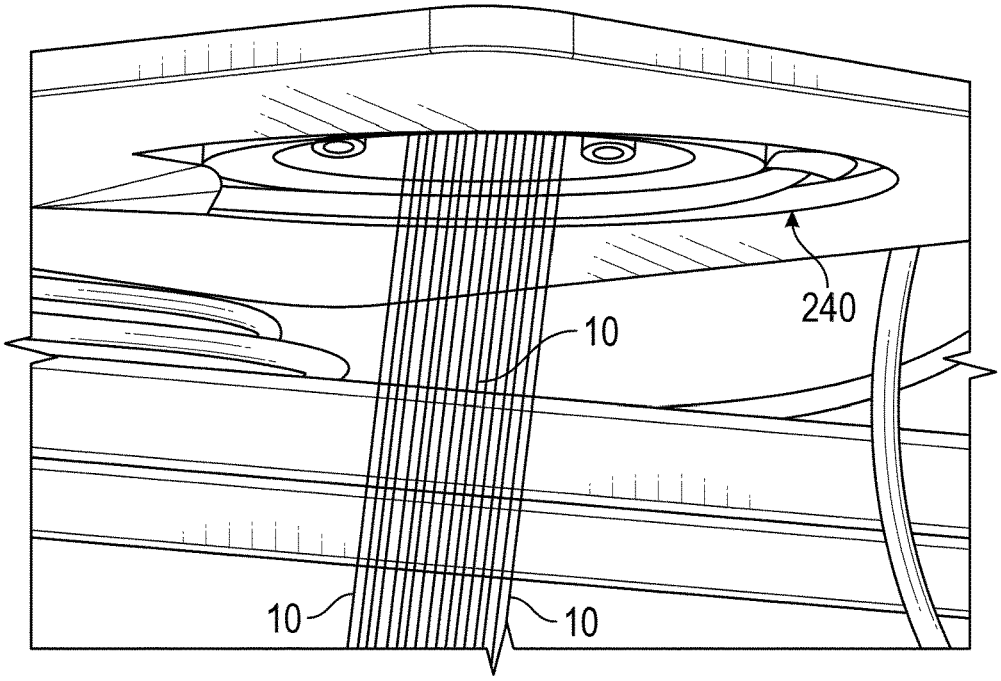
FIG. 15 is a detailed view of a multi-filament spinneret of the fiber fabrication machine of FIG. 9A, according to an exemplary embodiment.

The fabrication of the color-changing yarn 100 may be performed in many ways. In one embodiment, the color-changing fiber 10 on the fiber spool 280 is combined (e.g., twisted, braided, etc.) with (i) one or more other color-changing fibers 10 from other fiber spools 280 and/or (ii) one or more non-color-changing fibers from other spools. In another embodiment, multiple fiber fabricators 200 are set up in parallel (e.g., each including the hoppers, the screw extruders, the melt pumps, the spinnerets, etc.). The resultant color-changing fiber 10 from each fiber fabricator 200 may be fed into a combining machine (e.g., a braiding machine, etc.) that forms the color-changing yarn 100 from the plurality of color-changing fibers 10. The color-changing yarn 100 may then be spooled. In still another embodiment, as shown in FIG. 15, the spinneret 240 (e.g., a multi-filament spinneret, etc.) is configured to receive a plurality of the wires 206 and facilitate coating each of the plurality of wires 206 with the coating 14 such that a plurality of color-changing fibers 10 exit the spinneret 240 simultaneously. The plurality of color-changing fibers 10 may be individually spooled using respective winders 260 or the plurality of color-changing fibers 10 may be fed into a combining machine (e.g., a braiding machine, etc.) that forms the color-changing yarn 100 from the plurality of color-changing fibers 10. The multi-filament spinneret may also be adapted to work with the conductive core injection system 800 of FIG. 16.

Fabric Manufacturing

Figure 17:
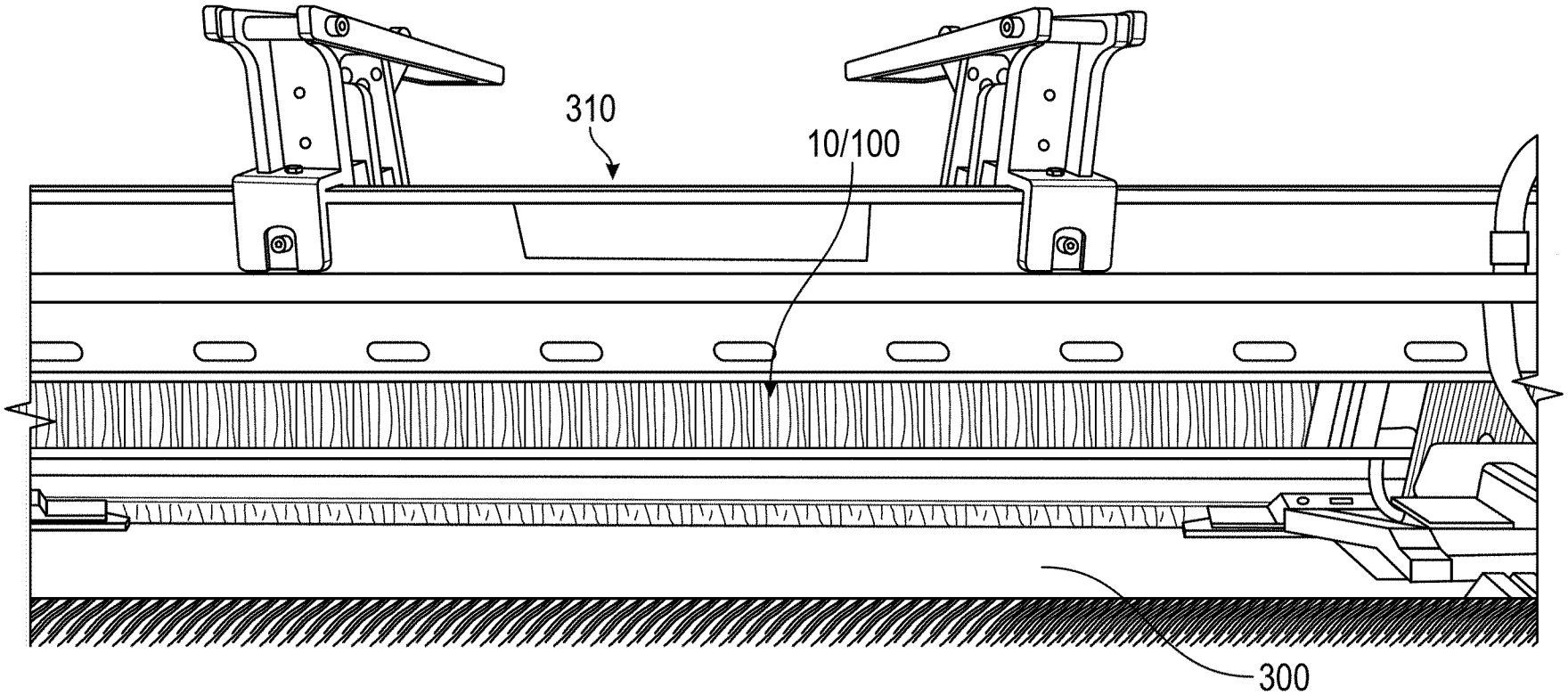
FIG. 17 is a detailed view of a fabric forming machine, according to an exemplary embodiment.
Figure 18:
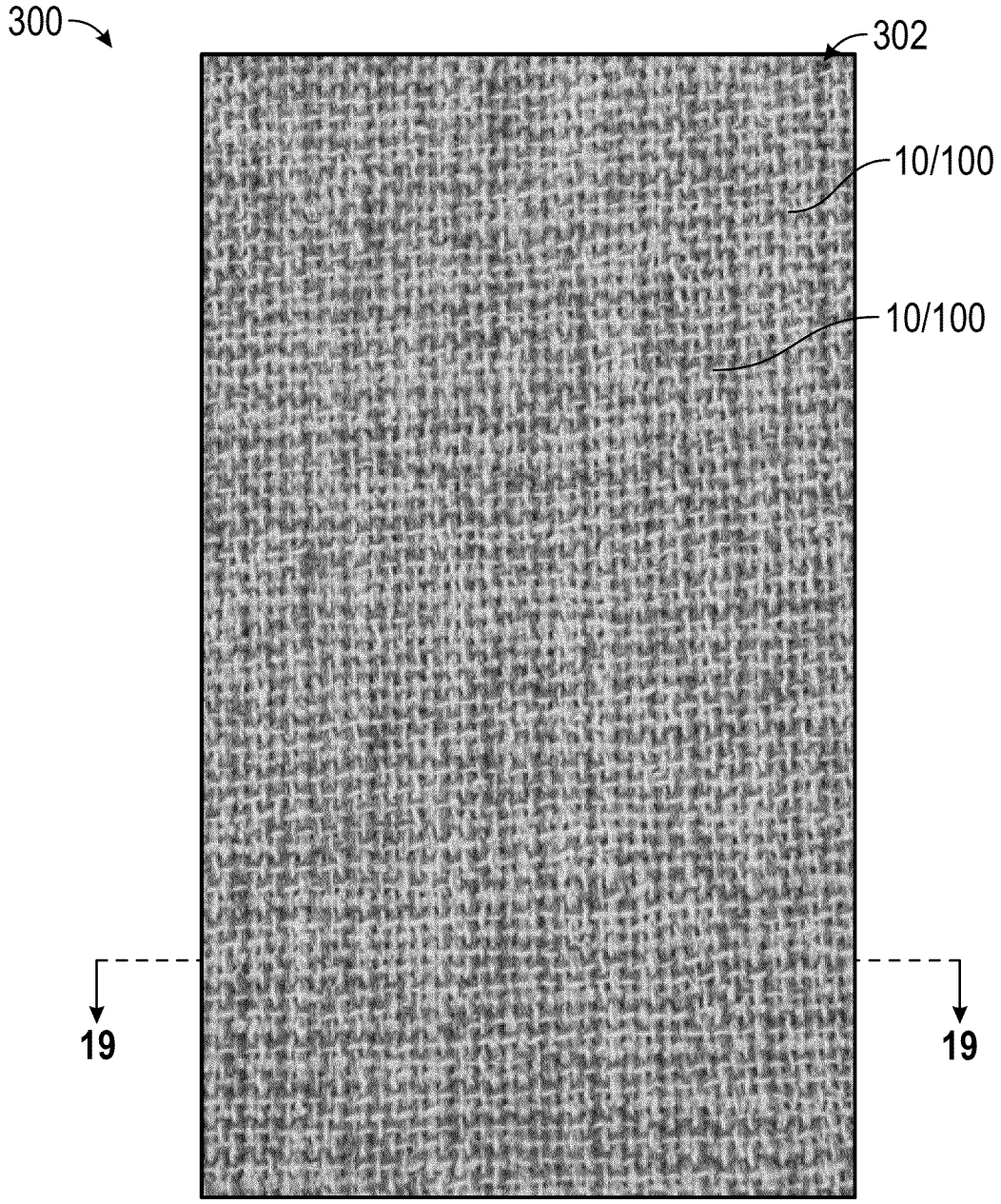
FIG. 18 is a plan view of a fabric arranged of color-changing fibers using the fabric forming machine of FIG. 17, according to an exemplary embodiment.
Figure 19:
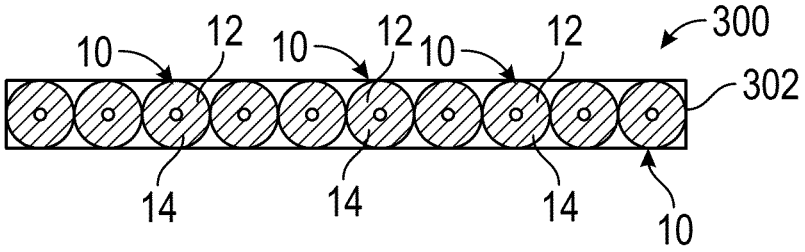
FIG. 19 is a cross-sectional view of the fabric of FIG. 19, according to an exemplary embodiment.

As shown in FIGS. 17-19, the color-changing fiber 10 can be: (i) combined with other fibers (e.g., the same color-changing fiber 10, a different color-changing fiber 10, a non-color-changing fiber, etc.) to make the color-changing yarn 100, which may then be woven with non-color-changing fibers or yarns (e.g., a cotton-nylon blend, etc.) to form a textile or fabric, shown as color-changing fabric 300 (e.g., the non-color-changing fibers or yarns are woven in a first direction of the fabric and the color-changing yarns 100 are woven in a second direction, etc.), (ii) woven directly with non-color-changing fibers or yarns to form the color-changing fabric 300 (e.g., the non-color-changing fibers or yarns are woven in a first direction of the fabric and the color-changing fibers 10 are woven in a second direction, etc.), (iii) combined with other fibers to make the color-changing yarn 100, which may then be knitted to form the color-changing fabric 300 (or a color-changing product directly), or (iv) knitted to form the color-changing fabric 300 (or the color-changing product directly).

Various weaving and/or knitting techniques may be used to arrange the color-changing fibers 10 and/or the color-changing yarns 100 into the color-changing fabric 300. By way of example, the weaving and/or knitting techniques may include a twill/herringbone weave, a satin weave, a loom weave, a basket weave, a plain weave, a Jacquard weave, an Oxford weave, a rib weave, courses and wales knitting, weft and warp knitting, and/or other suitable weaving and/or knitting techniques.

According to the exemplary embodiment shown in FIG. 17, a fabric forming machine, shown as fabric loom 310, is configured to weave one or more color-changing fibers 10, one or more color-changing yarns 100, one or more non-color-changing fibers, and/or one or more non-color-changing yarns to manufacture the color-changing fabric 300. In some embodiments, (i) one or more color-changing fibers 10 and/or one or more color-changing yarns 100 are woven in a first direction (e.g., a warp direction, a weft direction, etc.) and (ii) one or more non-color changing fibers and/or one or more non-color-changing yarns are woven in a second direction (e.g., the weft direction, the warp direction, etc.). In some embodiments, (i) one or more first color-changing fibers 10 and/or one or more first color-changing yarns 100 are woven in the first direction and one or more second color-changing fibers 10 and/or one or more second color-changing yarns 100 are woven in the second direction. As shown in FIGS. 18 and 19, at this stage in manufacturing, the color-changing fabric 300 includes only a first layer, shown as base layer 302, which contains the one or more color-changing fibers 10 that may have one or more background thermochromic pigments within the coatings 14 thereof.

In some embodiments, the base layer 302 does not include the background thermochromic pigments. In some embodiments, the base layer 302 has differing portions. By way of example, (i) one or more first portions of the base layer 302 may include background thermochromic pigments, which may be the same or different between the one or more first portions, and (ii) one or more second portions of the base layer 304 may not include a background thermochromic pigment. By way of another example, a first portion of the base layer 302 may include a first background thermochromic pigment and a second portion of the base layer 302 may include a second background thermochromic pigment that is different than the first background thermochromic pigment.

Pattern Printing

Figure 21:
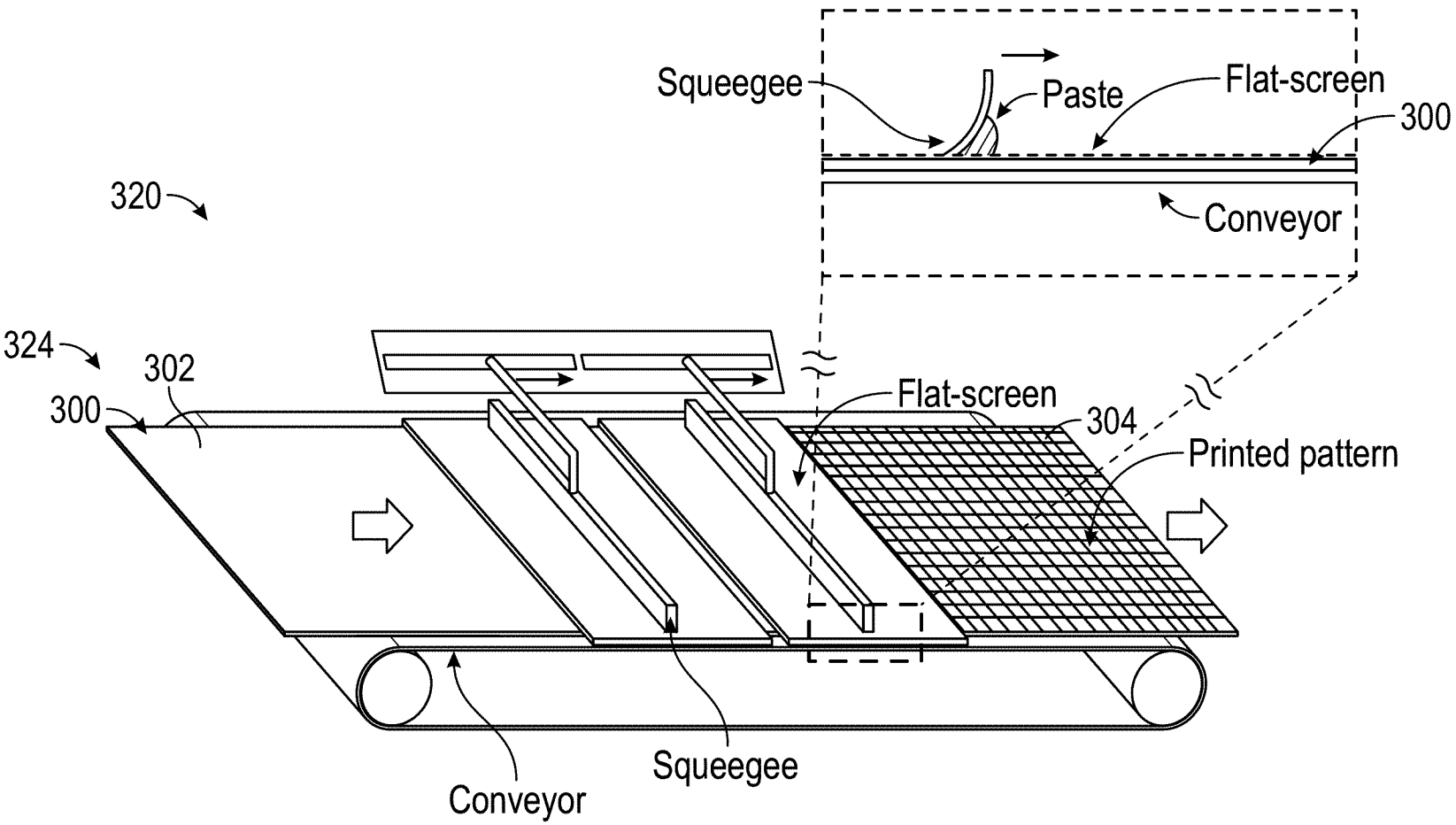
FIG. 21 is a perspective view of a printing machine for printing a pattern on the fabric of FIG. 18, according to another exemplary embodiment.
Figure 22:
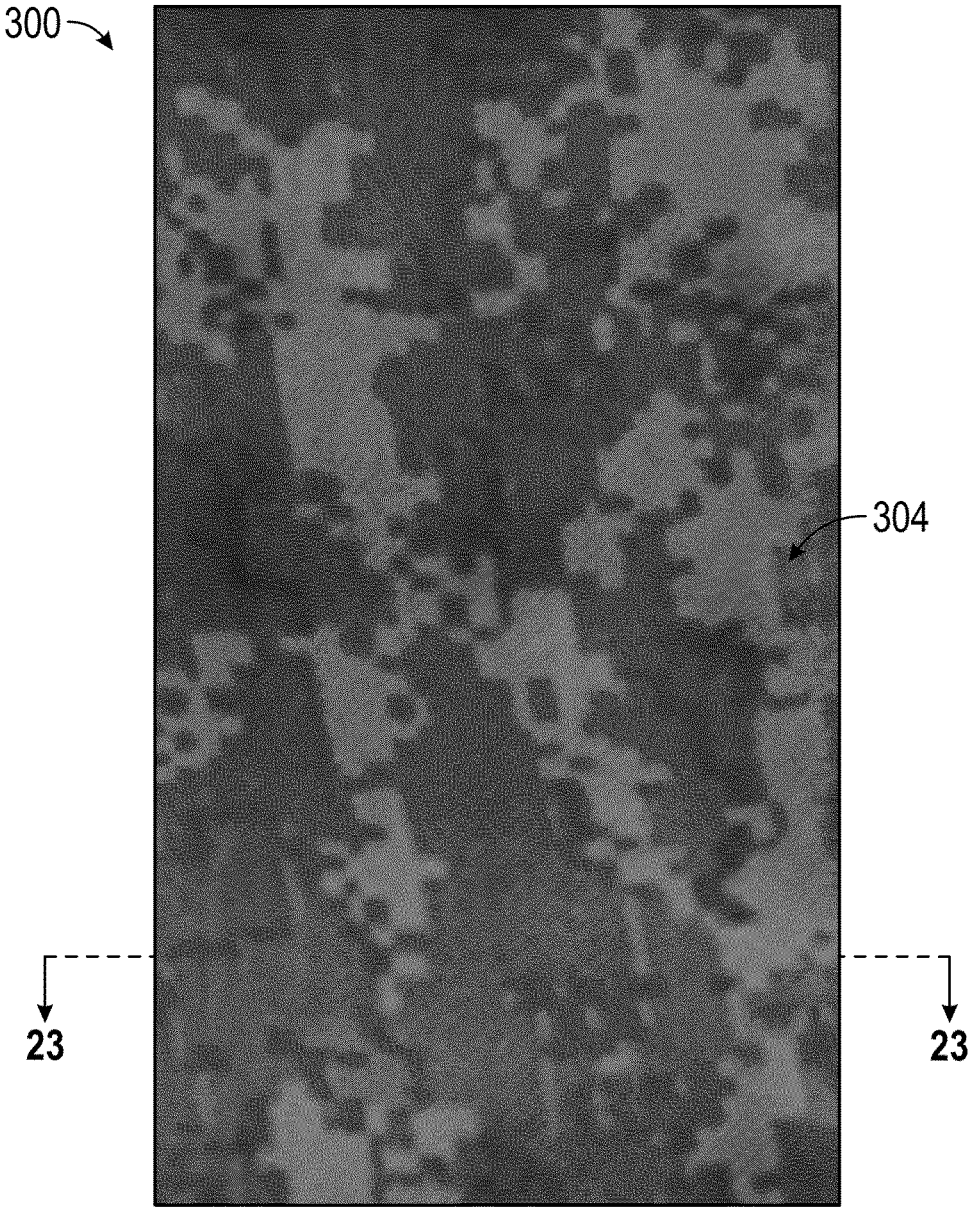
FIG. 22 is a plan view of the fabric of FIG. 18 having a pattern printed thereon using the printing machine of FIG. 20 or FIG. 21, according to an exemplary embodiment.
Figure 23:
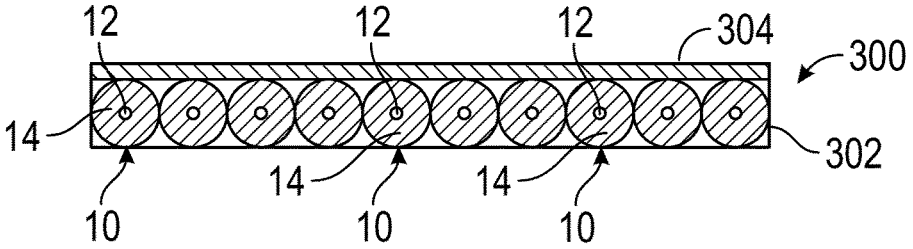
FIG. 23 is a cross-sectional view of the fabric of FIG. 22, according to an exemplary embodiment.

In some embodiments, the color-changing fabric 300 undergoes additional processing that includes printing a pattern onto the base layer 302. In some embodiments, the pattern printing is omitted. According to the exemplary embodiments shown in FIGS. 20-23, a printing machine, shown as screen printing machine 320, is configured to print a second layer, shown as pattern layer 304, onto the base layer 302. According to an exemplary embodiment, the pattern layer 304 includes one or more foreground thermochromic pigments. Accordingly, the background thermochromic pigments of the base layer 302 and the foreground thermochromic pigments of the pattern layer 304 are selectively activatable by providing an electrical current to the conductive cores 12 of the color-changing fibers 10 to change the background color and/or the foreground color of the color-changing fabric 300. The pattern layer 304 shown in FIG. 22 is illustrate as having a camouflage pattern, but according to various other exemplary embodiments, the pattern may differ from that shown and may or may not be provided as a camouflage pattern.

In some embodiments, the pattern layer 304 has differing portions. By way of example, (i) one or more first portions of the pattern layer 304 may include foreground thermochromic pigments, which may be the same or different between the one or more first portions, and (ii) one or more second portions of the pattern layer 304 may not include a foreground thermochromic pigment (e.g., includes a traditional, non-color-changing pigment; no pigment is printed on a portion, exposing the base layer 302; etc.). By way of another example, a first portion of the pattern layer 304 may include a first foreground thermochromic pigment and a second portion of the pattern layer 304 may include a second foreground thermochromic pigment that is different than the first foreground thermochromic pigment. In some embodiments, the pattern layer 304 does not include the foreground thermochromic pigments. By way of example, a first portion of the pattern layer 304 may include a non-color-changing pigment and a second portion of the pattern layer 304 may include no pigment (i.e., exposing the base layer 302). In some embodiments, a first portion of the pattern layer 304 includes one or more first sections having one or more foreground thermochromic pigments, a second portion of the pattern layer 304 includes one or more second sections having one or more non-color-changing pigments, and/or a third portion of the pattern layer 304 includes one or more third sections that do not include a pigment (i.e., expose the base layer 302).

Figure 20:
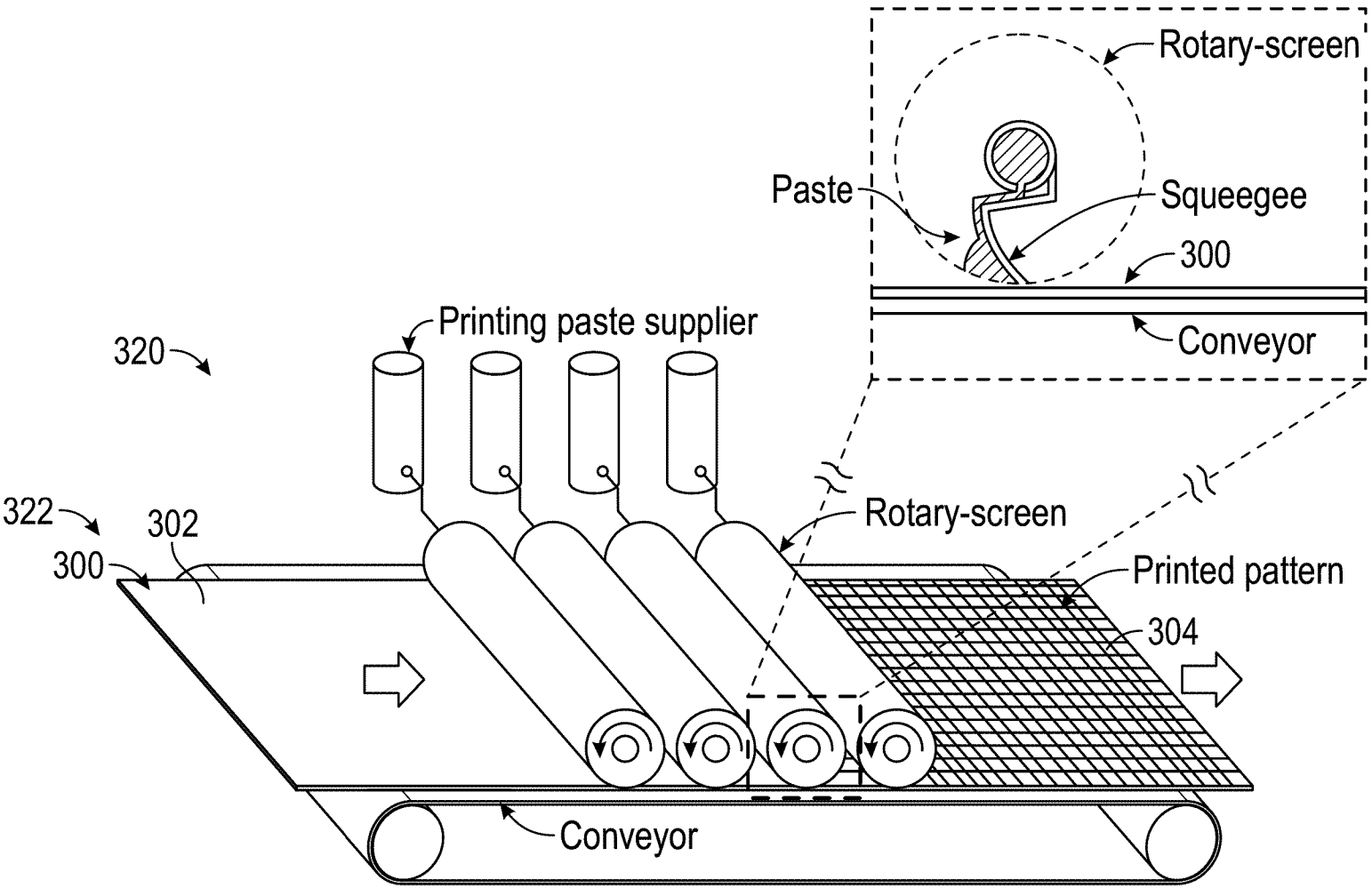
FIG. 20 is a perspective view of a printing machine for printing a pattern on the fabric of FIG. 18, according to an exemplary embodiment.

As shown in FIG. 20, the screen printing machine 320 is configured as a first screen printing machine, shown as rotary-screen printing machine 322. The rotary-screen printing machine 322 includes (i) a conveyor that translates/indexes the base layer 302 of the color-changing fabric 300 and (ii) one or more rotary-screens having applicators/squeegees that (a) are supplied a paste mixture containing the foreground thermochromic pigments and (b) apply the paste mixture to the base layer 302 as the base layer 302 translates along the conveyor to provide the pattern layer 304 thereon having a desired pattern. As shown in FIG. 21, the screen printing machine 320 is configured as a second screen printing machine, shown as flat-screen printing machine 324. The flat-screen printing machine 324 includes (i) a conveyor that translates/indexes the base layer 302 of the color-changing fabric 300 and (ii) one or more flat-screens having applicators/squeegees that (a) are supplied a paste mixture containing the foreground thermochromic pigments and (b) apply the paste mixture to the base layer 302 as the base layer 302 translates along the conveyor to provide the pattern layer 304 thereon having a desired pattern. As shown in FIG. 22, the pattern layer 304 of the color-changing fabric 300 includes a camouflage pattern. However, it should be understood that a variety of patterns other than camouflage are possible (e.g., striped patterns, checkered patterns, logos, phrases, pictures, abstract patterns, tessellations, etc.). Further, while the pattern printing process described herein is a screen-printing process, it should be understood that other suitable processes may be used to print or otherwise apply the pattern layer 304 onto the base layer 302 (e.g., dye sublimation, direct to garment ("DTG"), heat press printing, vinyl cutting, etc.).

Electrical Connectorization

Figure 24:
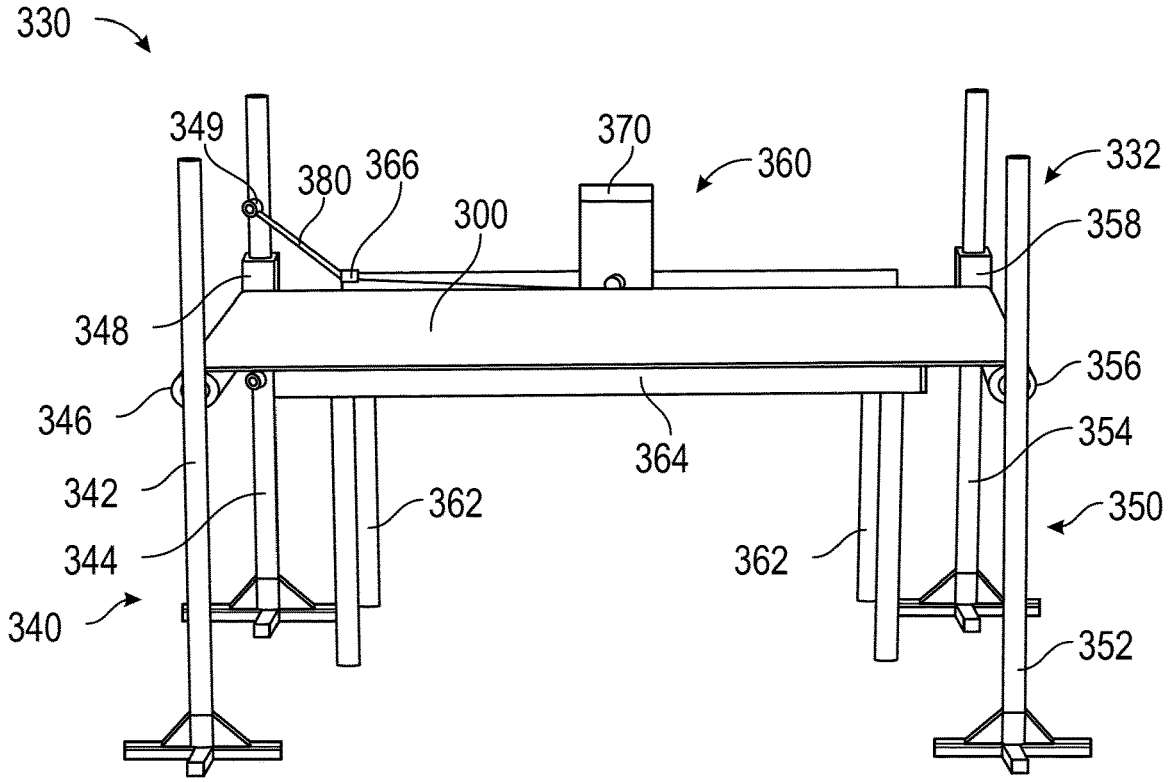
FIG. 24 is a front view of an electrical connectorization system for electrically connecting the color-changing fibers of the fabric of FIG. 22, according to an exemplary embodiment.

In some embodiments, the color-changing fabric 300 undergoes additional processing that includes electrically connecting the conductive cores 12 thereof. The electrical connectorization may occur prior to pattern printing or after pattern printing (if pattern printing is performed on the color-changing fabric 300). As shown in FIG. 24, an electrical connectorization system, shown as connectorization system 330, is configured to facilitate electrically connecting the conductive cores 12 together. The connectorization system 330 includes a support frame, shown as frame assembly 332, and an electrical connectorization device, shown as ultrasonic welder 370. The frame assembly 332 has a first support structure, shown as feed rack 340, a second support structure, shown as intake rack 350, and a third support structure, shown as platform 360, positioned between the feed rack 340 and the intake rack 350. While shown as separate components, in some embodiments, the feed rack 340, the intake rack 350, and the platform 360 are integrated into a single structure.

As shown in FIG. 24, the feed rack 340 includes a first pair of supports, shown as feed support 342 and feed support 344, spaced from one another; a first roller, shown as feed roller 346, extending between the feed support 342 and the feed support 344 and configured to secure a roll of the color-changing fabric 300 to the feed rack 340; a first motor, shown as feed motor 348, positioned to drive the feed roller 346; and an interface, shown as bus interface 349, extending from the feed support 344, positioned above the feed roller 346, and configured to receive a spool of an electrical bus (e.g. a bus foil, etc.), shown as bus 380. In some embodiments, the feed rack 340 does not include the feed motor 348. As shown in FIG. 24, the intake rack 350 includes a second pair of supports, shown as intake support 352 and intake support 354, spaced from one another; a second roller, shown as intake roller 356, extending between the intake support 352 and the intake support 354 and configured to receive and roll/wind up the color-changing fabric 300 having the bus 380 secured thereto by the ultrasonic welder 370; and a second motor, shown as intake motor 358, positioned to drive the intake roller 356.

As shown in FIG. 24, the platform 360 includes a plurality of legs, shown as legs 362; a support surface, shown as welding surface 364, coupled to the legs 362 and that supports the color-changing fabric 300 and the ultrasonic welder 370 during the welding process; and a guide, shown as bus guide 366, coupled to the welding surface 364 and positioned to receive and direct the bus 380 from the bus interface 349 along the edge of the color-changing fabric 300 to be welded thereto by the ultrasonic welder 370. According to an exemplary embodiment, the feed roller 346, the intake roller 356, and the welding surface 364 are all positioned at a height such that the color-changing fabric 300 remains flat or horizontal through the welding region.

Figure 26:
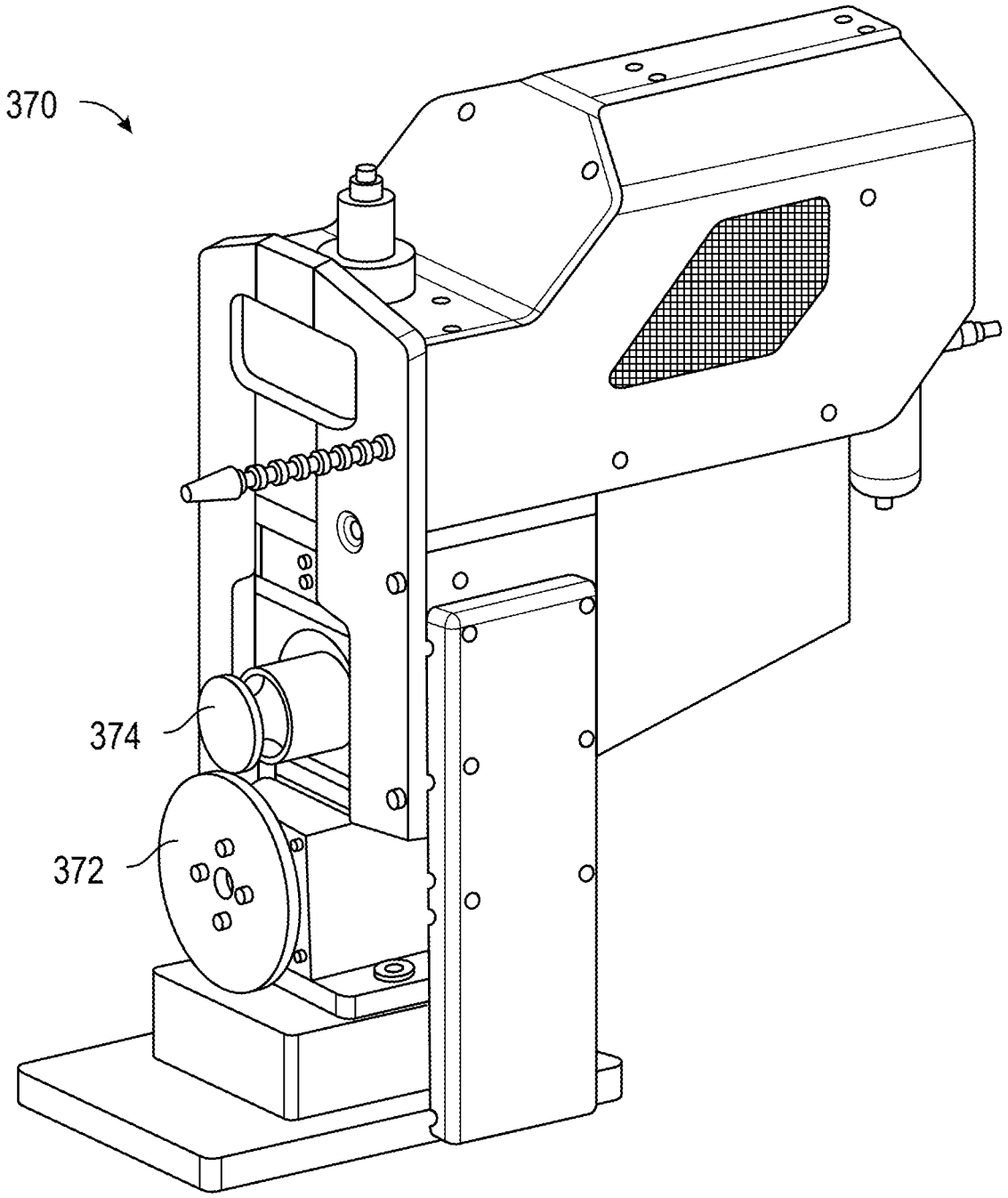
FIG. 26 is a perspective view of an electrical connectorization device of the electrical connectorization system of FIG. 24, according to an exemplary embodiment.

As shown in FIG. 26, the ultrasonic welder 370 includes a base, shown as anvil 372, and a head, shown as horn 374, aligned with the anvil 372. According to the exemplary embodiment shown in FIG. 26, the anvil 372 and the horn 374 are cylindrical, circular plate, or disk shaped. In some embodiments, the anvil 372 and/or the horn 374 are smooth. In some embodiments, the anvil 372 and/or the horn 374 are knurled. According to an exemplary embodiment, the ultrasonic welder 370 is configured to manipulate the horn 374 such that the horn 374 applies pressure to and oscillates relative to the anvil 372, while the anvil 372 and the horn 374 rotate relative to one another (e.g., in opposing rotational directions, etc.) to form a bond between (i) the bus 380 and (ii) the color-changing fabric 300. According to an exemplary embodiment, the ultrasonic welder 370 is capable of oscillating the horn 374 at a frequency up to 40 kilohertz ("kHz") with an amplitude up to 30 micrometers ("μm") while providing a pressure of up to 60 pounds per square inch ("psi"). In other embodiments, the ultrasonic welder 370 is capable of oscillating the horn 374 at a frequency greater than 40 kHz with an amplitude up to greater than 30 μm and with a pressure greater than 60 psi.

According to an exemplary embodiment, the ultrasonic welder 370 is positioned relative to or coupled to the welding surface 364 such that the interface between the anvil 372 and the horn 374 is at the same level as the color-changing fabric 300 as the color-changing fabric 300 moves along the welding surface 364 between the feed roller 346 and the intake roller 356. According to an exemplary embodiment, the feed motor 348, the intake motor 358, and/or the anvil 372 and the horn 374 are configured to cooperate to guide and push/pull the color-changing fabric 300 and the bus 380 from the feed roller 346 and bus spool at the bus interface 349, respectively, through the ultrasonic welder 370 to the intake roller 356 to provide the color-changing fabric 300 having the bus 380 welded thereto (e.g., a continuous weld along the edge of the color-changing fabric 300; see, e.g., FIGS. 27 and 28; etc.).

Figure 25:
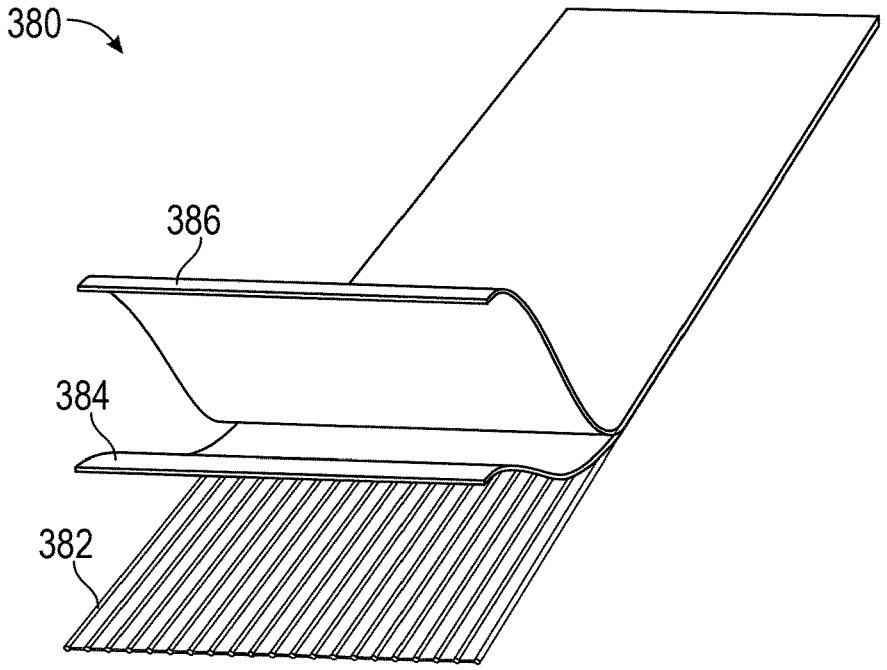
FIG. 25 is a perspective view of a multi-layer bus usable with the electrical connectorization system of FIG. 24, according to an exemplary embodiment.

As shown in FIG. 25, the bus 380 has a multi-layer structure with a first, outer layer, shown as canvas layer 382; a second, middle layer, shown as foil layer 384; and a third, inner layer, shown as film layer 386. The foil layer 384 may be manufactured from a metallic material such as copper, aluminum, or another suitable metallic material to perform the function described herein. The film layer 386 may be manufactured from a polycarbonate film or other suitable material to perform the function described herein. According to an exemplary embodiment, the canvas layer 382 is configured to increase friction between the horn 374 of the ultrasonic welder 370 and the materials below the canvas layer 382 such that energy from the vibration of the horn 374 can be efficiently transferred through the bus 380 to the color-changing fabric 300. Higher energy may, therefore, be transferred to the conductive cores 12 during the welding process, which effectively clears away the coating 14 on the conductive cores 12 and removes any oxidation that may have formed on the surface of the conductive cores 12 providing an improved electrical connection. The foil layer 384 is configured to create an electrical contact that allows current to flow through the bus 380 and into the conductive cores 12 of the color-changing fabric 300. The film layer 386 is configured to soften during the ultrasonic welding process and act as an adhesive that reinforces the mechanical stability of the bus 380 on the color-changing fabric 300 and electrically isolates/insulates the weld from the surrounding environment. The multi-layer structure of the bus 380 may, therefore, provide three main functions: (i) improved electrical connectorization, (ii) increased mechanical ruggedization, and (iii) electrical insulation.

In some embodiments, the bus 380 is folded along the edge of the color-changing fabric 300 such that the bus 380 is positioned on the top and bottom of the color-changing fabric 300. In some embodiments, individual buses 380 are positioned on the top and bottom of the color-changing fabric 300 and aligned with one another. In other embodiments, the bus 380 only includes the foil layer 384 or includes one or more metallic wires. In such embodiments, the color-changing fabric 300 may include a cover (e.g., a fabric cover, etc.) positioned over the welds and secured (e.g., glued, welded, stitched, etc.) along the edge of the color-changing fabric 300. The cover may be positioned to protect and insulate the connections of the welds between the bus 380 and the conductive cores 12.

While the connectorization system 330 has been described as forming a continuous weld of the bus 380 along the edge of the color-changing fabric 300, in some embodiments, the color-changing fabric 300 includes a plurality of discrete and separate pieces of the bus 380 along the edge thereof. In some embodiments, the connectorization system 330 includes a cutting/isolation apparatus that works alongside the ultrasonic welder 370. The cutting/isolation apparatus is configured to cut or otherwise isolate the bus 380 at programmed intervals as it is applied to the color-changing fabric 300 by the ultrasonic welder 370 to provide groups of the conductive cores 12 that are electrically connected.

Figure 28:
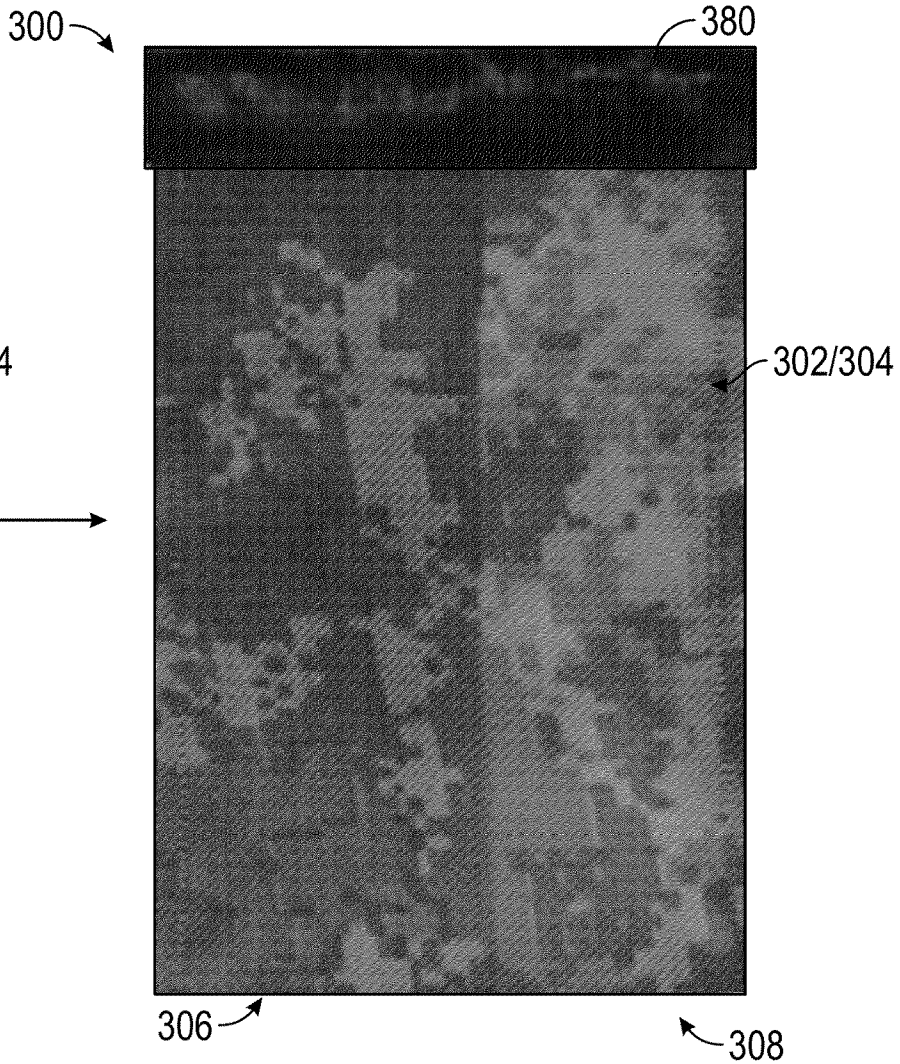
FIG. 28 is a plan view of the fabric of FIG. 27 with a portion thereof in a second state, according to an exemplary embodiment.
Figure 27:
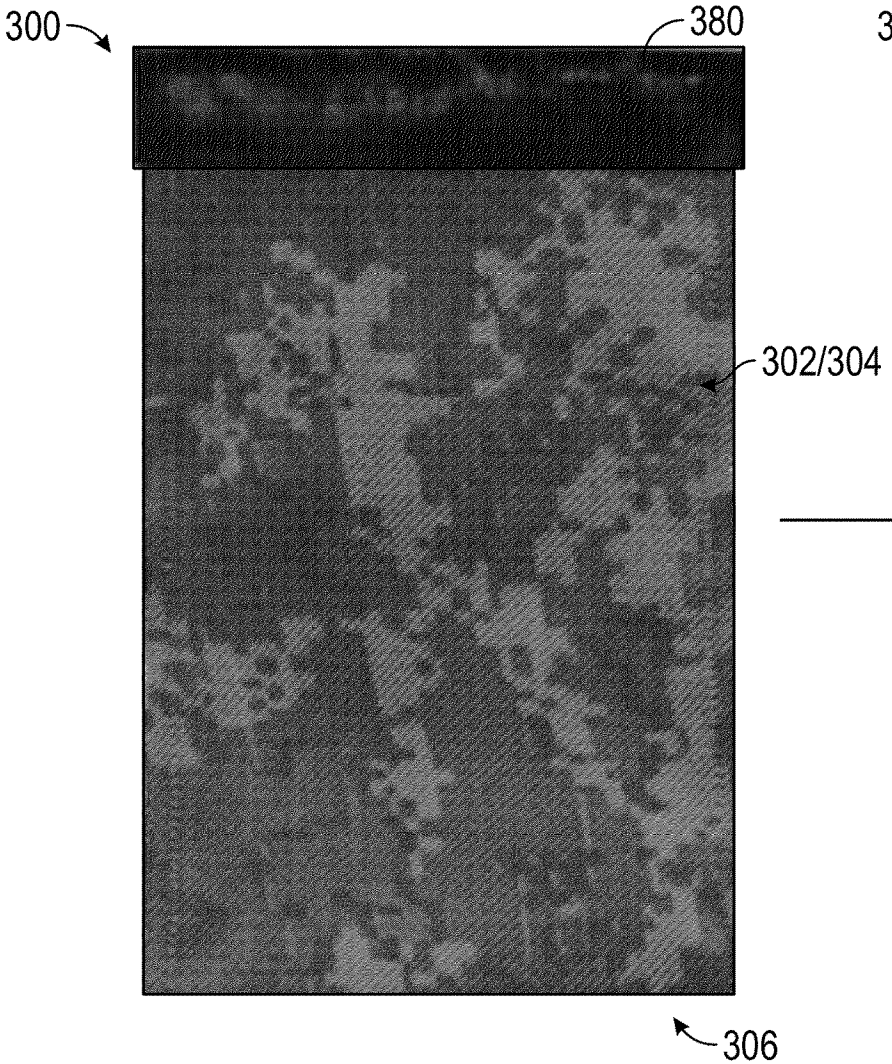
FIG. 27 is a plan view of the fabric of FIG. 22 (i) with the color-changing fibers thereof electrically connected using the electrical connectorization system of FIG. 25 and (ii) in a first state, according to an exemplary embodiment.

As shown in FIGS. 27 and 28, one or more busses 380 electrically couple one or more groupings of the conductive cores 12 of color-changing fabric 300 such that when the busses 380 are electrified the electricity transfers to the conductive cores 12 connected thereto. The conductive cores 12 then elevate in temperature, which activates the background thermochromic pigment(s) of the base layer 302 (if the coatings 14 include the background thermochromic pigments) and/or the foreground thermochromic pigment(s) of the pattern layer 304 to transition a visual characteristic of at least a portion of the color-changing fabric from a first state (e.g., a darker camouflage pattern, a first camouflage pattern, etc.), shown as state 306, to a second state (e.g., a lighter camouflage pattern, a second camouflage pattern, etc.), shown as state 308.

Applications

Figure 30:
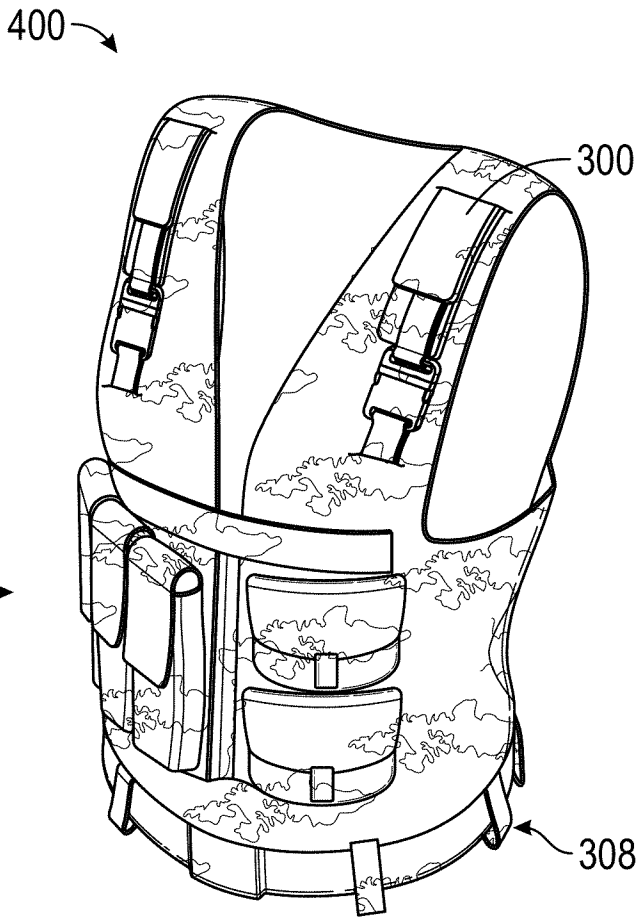
FIG. 30 is a perspective view of the color-changing product of FIG. 29 in a second state, according to an exemplary embodiment.
Figure 29:
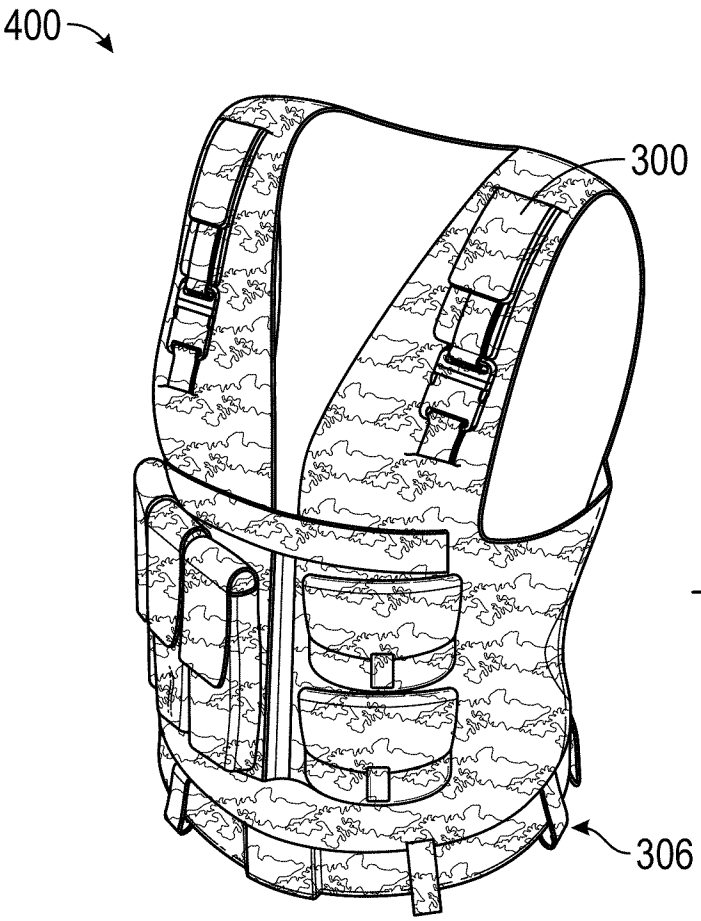
FIG. 29 is a perspective view of a color-changing product (i) formed using the fabric of FIG. 27 and (ii) in a first state, according to an exemplary embodiment.

According to an exemplary embodiment, the color-changing fibers 10 and/or the color-changing yarns 100 are capable of being incorporated into existing products (e.g., using embroidery, as a patch, etc.) and/or arranged to form the color-changing fabric 300 (e.g., using weaving, knitting, etc.) with color-changing capabilities. As shown in FIGS. 29 and 30, the color-changing fabric 300 can be arranged (e.g., cut, sewn, etc.) to form a consumer product, shown as color-changing product 400. According to the exemplary embodiment shown in FIGS. 29 and 30, the color-changing product 400 is configured as a camouflage vest that is capable of being selectively transitioned between the state 306 and the state 308. In this embodiment, the state 306 is a jungle camouflage pattern and the state 308 is a desert camouflage pattern. In other embodiments, the type of the camouflage pattern of the state 306 and/or the state 308 are different (e.g., for daytime, for nighttime, for different season, for desert locations, for snow locations, for forest locations, for urban locations, for other environmental conditions, etc.) based on the background thermochromic pigment(s) of the base layer 302, the foreground thermochromic pigments of the pattern layer 304, the printed pattern of the pattern layer 304, the temperature of the conductive cores 12, and/or still other characteristics of the color-changing fibers 10 and/or the color-changing fabrics 300. In still other embodiments, the state 306 and/or the state 308 are not camouflage patterns but rather are other types of patterns (e.g., striped patterns, checkered patterns, logos, phrases, pictures, abstract patterns, tessellations, etc.).

As described above, the base layer 302 can be provided with various different arrangements (e.g., with thermochromic pigments, without thermochromic pigments, with differing portions, etc.) and the pattern layer 304 can also be provided with various different arrangements (e.g., with thermochromic pigments, without thermochromic pigments, differing portions, etc.). The differing arrangements of the base layer 302 and the pattern layer 304, and the various possible combinations thereof, facilitate providing numerous different color-changing capabilities of the color-changing fabric 300 and the color-changing product 400. By way of example, the foreground color may change while the background color may remain static. By way of another example, a first portion of the foreground may change color while a second portion of the foreground may remain static (i.e., a portion that does not include thermochromic pigments). The static portion of the foreground may be affected by a color change of the background beneath it, however. By way of still another example, the foreground color may disappear (i.e., become transparent), exposing the background color (e.g., a dark foreground color printed over a light background color, etc.). By way of another example, the combination of the background color and foreground color may be designed to create varying shades or colors to the eye. For example, a first foreground color (e.g., black, etc.) may be printed on top of a second background color (e.g., red, etc.) to provide a third color (e.g., a deep red color, etc.). As the first color is transitioned (e.g., to transparent, etc.), the shade of third color may start to become brighter and more vibrant (e.g., more red, etc.). The background color may also change to provide even further color combinations. For example, the foreground color may change at a first temperature and the background color may change at a second higher temperature. Therefore, the colors may transition between three or more colors.

According to various other exemplary embodiments, the color-changing fabric 300 can be arranged (e.g., cut, sewn, etc.) to form other types of color-changing products 400 such as: (i) apparel such as headbands, wristbands, ties, bowties, shirts, jerseys, gloves, scarves, jackets, vests, pants, shorts, dresses, skirts, blouses, footwear/shoes, belts, hats, etc.; (ii) accessories such as purses, backpacks, luggage, wallets, jewelry, hair accessories, etc.; (iii) home goods, décor, and fixed installations such as curtains, window blinds, furniture and furniture accessories, table cloths, blankets, bed sheets, pillow cases, rugs, carpet, wallpaper, art/paintings, automotive interiors, etc.; (iv) outdoor applications and equipment such as tents, awnings, umbrellas, canopies, tarps, signage, etc.; and/or (v) still other suitable applications.

Product Control System

Any of a variety of systems and methods may be used to control the color-changing fibers 10, the color-changing yarns 100, the color-changing fabrics 300, and/or the color-changing products 400 disclosed herein. According to the exemplary embodiment shown in FIG. 31, a control system, shown as control system 600, is coupled (e.g., electrically coupled, communicatively coupled, mechanical coupled, etc.) to the color-changing product 400 and includes a control device, shown as controller 610, a power source, shown as power supply 620, and a user input, shown as input device 630. The controller 610 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components. According to the exemplary embodiment shown in FIG. 31, the controller 610 includes a processing circuit having a processor 612 and a memory 614. The processing circuit may include an ASIC, one or more FPGAs, a DSP, circuits containing one or more processing components, circuitry for supporting a microprocessor, a group of processing components, or other suitable electronic processing components. In some embodiments, the processor 612 is configured to execute computer code stored in the memory 614 to facilitate the activities described herein. The memory 614 may be any volatile or non-volatile computer-readable storage medium capable of storing data or computer code relating to the activities described herein. According to an exemplary embodiment, the memory 614 includes computer code modules (e.g., executable code, object code, source code, script code, machine code, etc.) configured for execution by the processor 612.

Figure 31:
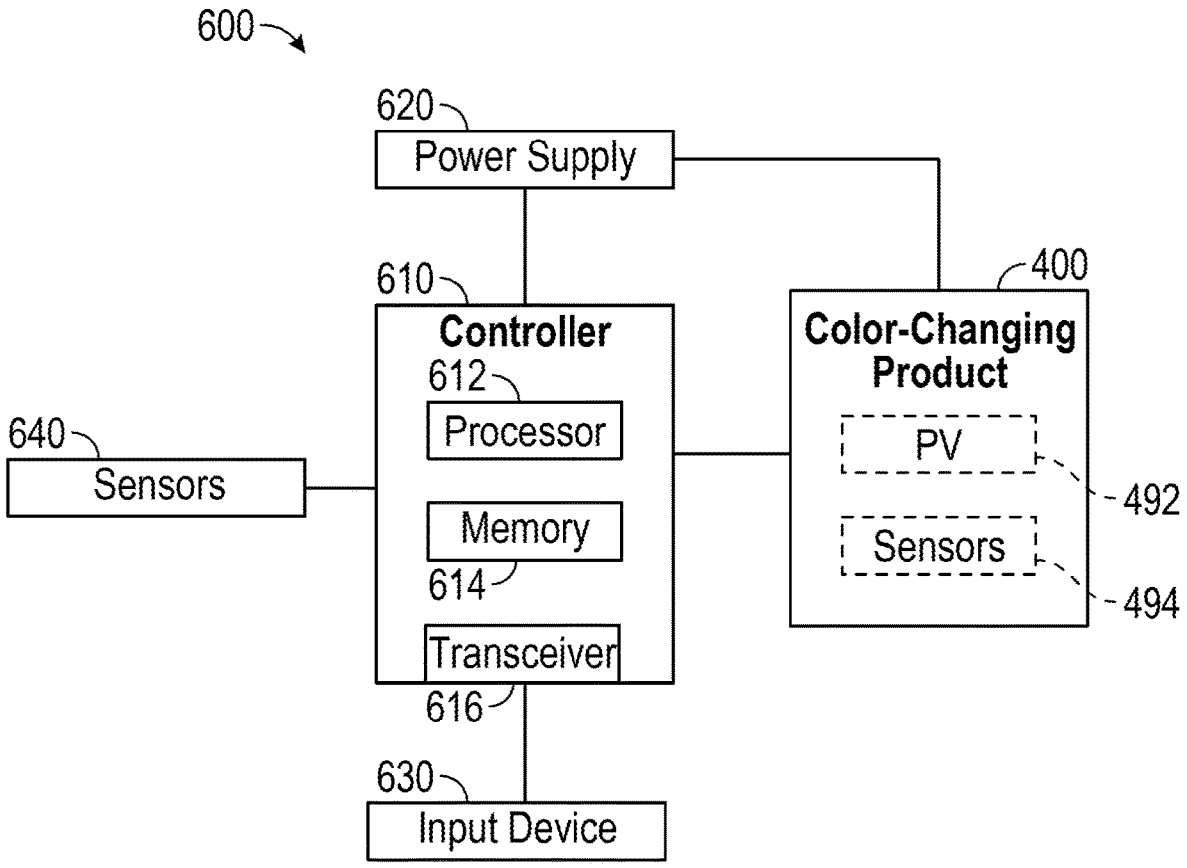
FIG. 31 is a schematic diagram of a control system for the color-changing product of FIG. 29, according to an exemplary embodiment.

As shown in FIG. 31, the controller 610 includes a communications interface, shown as transceiver 616. The transceiver 616 is configured to send and receive signals between the controller 610, the power supply 620, the input device 630, the color-changing product 400 (e.g., sensors thereof, etc.), and/or sensors, shown as sensors 640. The transceiver 616 may facilitate wired and/or wireless (e.g., Bluetooth, NFC, Zigbee, radio, cellular, Wi-Fi, short-range, long-range, etc.) communication. By way of example, the transceiver 616 may include one or more ports to facilitate making a wired connection. By way of another example, the transceiver 616 may include wireless components (e.g., Bluetooth components, Wi-Fi components, a cellular chip, etc.) to facilitate wireless communication.

According to an exemplary embodiment, the power supply 620 is configured to facilitate selectively providing an electrical current to the color-changing fibers 10 and/or the color-changing yarns 100 of the color-changing product 400 (e.g., based on commands provided by the controller 610, etc.) to activate the background thermochromic pigments in the coatings 14 and/or the foreground thermochromic pigments in the pattern layer 304. The power supply 620 may be a rechargeable battery pack, a replaceable battery pack, and/or another suitable power supply. The power supply 620 may be chargeable using a direct connection to an external power source (e.g., a mains power line, etc.), wirelessly using wireless charging technology, and/or require that batteries therein be replaced on occasion. In some embodiments, as shown in FIG. 31, the color-changing product 400 includes a photovoltaic source, shown as PV source 492. The PV source 492 may be or include photovoltaic fibers incorporated into the color-changing yarns 100, an independent photovoltaic patch, etc. The PV source 492 may charge the power supply 620, supplement the power supply 620 in providing current to the color-changing fibers 10, and/or, in some embodiments, obviate the need for the power supply 620 altogether.

Figure 32:
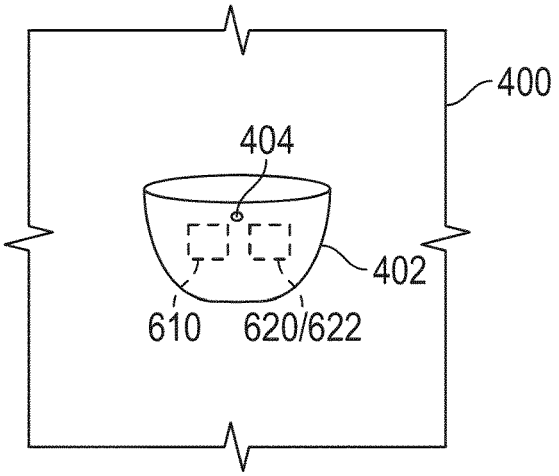
FIG. 32 is a detailed view of a controller and power supply stored within a color-changing product, according to an exemplary embodiment.

As shown in FIG. 32, the color-changing product 400 includes a compartment, shown as pocket 402. In one embodiment, the pocket 402 is positioned along an interior of the color-changing product 400 (e.g., along an inner lining, etc.) such that the pocket 402 is accessible from the interior of the color-changing product 400. In another embodiment, the pocket 402 is positioned along an exterior of the color-changing product 400 (e.g., along a sleeve, a back, a side, etc.) such that the pocket 402 is accessible from the exterior of the color-changing product 400. As shown in FIG. 32, the pocket 402 is configured to receive and store the controller 610 and/or the power supply 620. The power supply 620 may therefore be a removable power source, shown as battery pack 622, that is selectively removable, replaceable, and/or rechargeable. The battery pack 622 may be charged via a direct charging connection (e.g., inserted into a charging apparatus, connected to a charging cable, etc.) or wirelessly (e.g., using wireless charging technology, etc.). As shown in FIG. 32, the pocket 402 includes a securing element, shown as button 404, positioned to selectively enclose and secure the controller 610 and/or the battery pack 622 within the pocket 402. In other embodiments, the securing element additionally or alternatively is or includes a clip, a zipper, Velcro, and/or another suitable securing element that facilitates selectively closing the pocket 402.

In some embodiments, the color-changing product 400 does not include the pocket 402. In such embodiments, the controller 610 and/or the power supply 620 may be integrated into the color-changing product 400. By way of example, the controller 610 and/or the power supply 620 may be directly coupled to the color-changing product 400 (e.g., with clips, Velcro, sewn thereto, etc.). By way of another example, the controller 610 and/or the power supply 620 may be disposed within a liner of the color-changing product 400 (e.g., with the insulation of a liner within a vest or jacket, etc.). In such an embodiment, the color-changing product 400 may include a charging port that facilitates charging the internally disposed power supply 620. By way of another example, the power supply 620 may be a "free-floating" power supply that is carried by the wearer or within a compartment of the color-changing product 400 (e.g., a pursue compartment, a bag compartment, a jacket pocket, etc.) and may be selectively connectable to the controller 610 and/or the other components of the color-changing product 400 (e.g., directly, using a connection port within the compartment, etc.).

Figure 33:
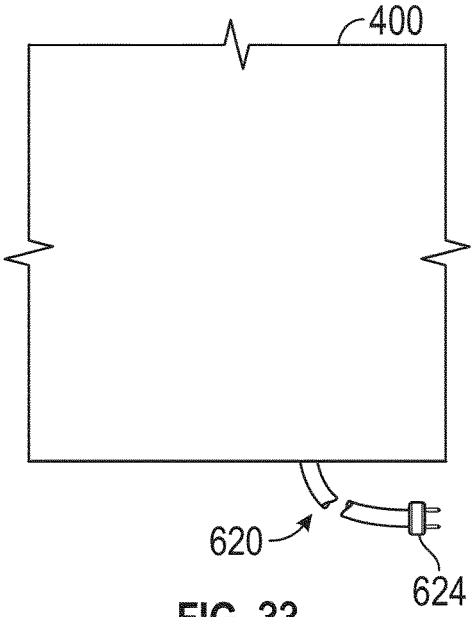
FIG. 33 is a detailed view of a wired power supply for a color-changing product, according to an exemplary embodiment.

As shown in FIG. 33, the power supply 620 of the color-changing product 400 additionally or alternatively includes a cord, shown as power cord 624. According to an exemplary embodiment, the power cord 624 is configured to interface with a wall socket, generator, or other external power source to power the color-changing product 400. In some embodiments, the power cord 624 is integrated directly into a power grid of a building or vehicle. Such a power supply 620 may be more suitable for color-changing products 400 that are not frequently moving (e.g., fixed applications, furniture, décor, tents, tarps, etc.) and, therefore, may not require a portable power supply.

Figure 34:
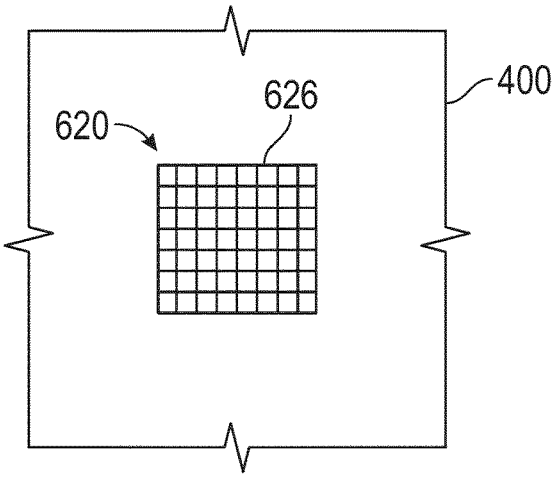
FIG. 34 is a detailed view of a solar panel/patch power supply for a color-changing product, according to an exemplary embodiment.

As shown in FIG. 34, the power supply 620 of the color-changing product 400 additionally or alternatively includes a solar cell array, shown as solar panel 626. According to an exemplary embodiment, the solar panel 626 includes a plurality of photovoltaic cells configured to generate electrical energy from light energy. The solar panel 626 may be removably coupled to or integrated into the color-changing product 400 or positioned remotely from the color-changing product 400 and connected therewith via a wired connection.

According to an exemplary embodiment, the input device 630 is configured to facilitate a user or operator of the color-changing product 400 with selectively controlling the visual appearance (e.g., color, pattern, etc.) of the color-changing product 400 (e.g., may be used to remotely control the color and/or pattern of the color-changing fabric 300, etc.). The input device 630 may be configured to communicate with the controller 610 via any suitable wireless communication protocol (e.g., Bluetooth, NFC, Zigbee, radio, cellular, Wi-Fi, etc.) and/or wired communication protocol. The input device 630 may be a cellular phone, a "smart" phone, a remote control, a computing device such as a laptop computer, a switch device, a button device, a touch-sensitive feature, a "smart home" controller device or hub (e.g., Amazon Alexa, Google Home, Z-wave controller, etc.), etc.

Figure 35:
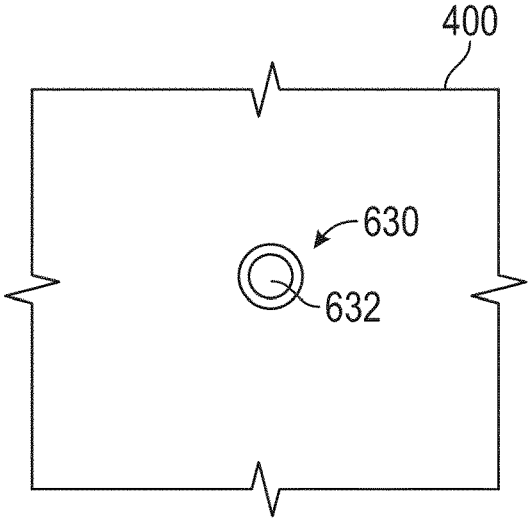
FIG. 35 is a detailed view of a button input device of a color-changing product, according to an exemplary embodiment.

As shown in FIG. 35, the input device 630 is configured as a button or switch device, shown as button 632. The button 632 may be secured to or positioned within the fabric of the color-changing product 400. By way of example, the button 632 may be disposed within or along a sleeve of a garment, along an interior breast portion of a garment, at an edge of a garment/product (e.g., the bottom edge of a shirt, etc.), and/or still otherwise positioned. The button 632 may allow a user to selectively activate and deactivate predefined or preset color-changing and/or pattern-changing features of the color-changing product 400 at the activation of the button 632.

Figure 36:
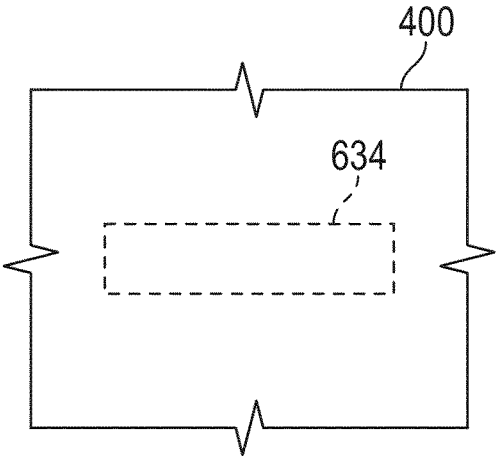
FIG. 36 is a detailed view of a touch-sensitive input device of a color-changing product, according to an exemplary embodiment.

As shown in FIG. 36, the input device 630 is configured as a touch-sensitive feature, shown as touch-sensitive portion 634. The touch-sensitive portion 634 may be secured to or integrated with the fabric of the color-changing product 400. By way of example, the touch-sensitive portion 634 may be disposed within or along a sleeve of a garment, along an edge of a product, along an interior of a product, and/or still otherwise positioned. The touch-sensitive portion 634 may allow a user to selectively activate and deactivate predefined or preset color-changing and/or pattern-changing features of the color-changing product 400 in response to receiving touch gestures. By way of example, the touch-sensitive portion 634 may be configured to identify one or more touch gestures such as a tap motion, a swipe motion, a pinch motion, etc. and provide a corresponding signal to the controller 610 to take an appropriate action based on the identified touch gesture.

Figure 37:
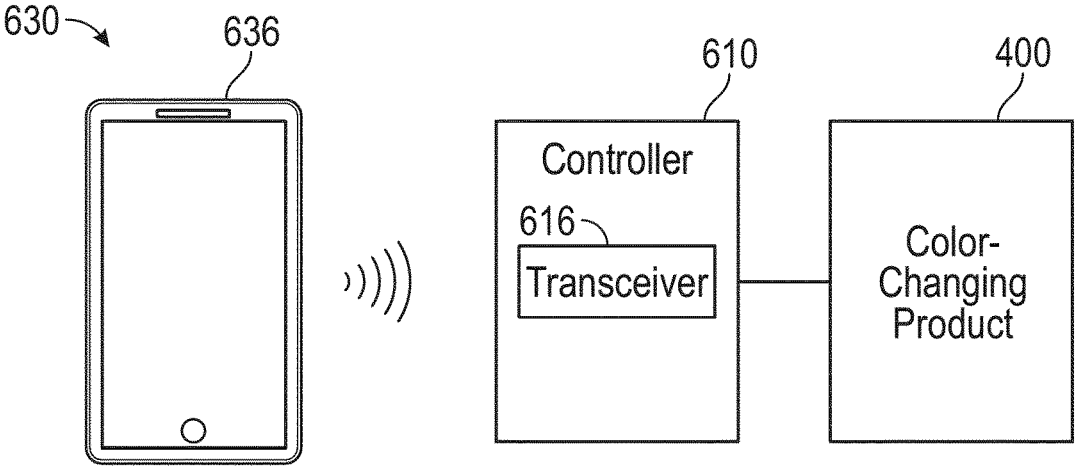
FIG. 37 is a detailed view of a portable input device useable with a color-changing product, according to an exemplary embodiment.

As shown in FIG. 37, the input device 630 is a portable device, shown as smartphone 636. In other embodiments, the portable device is another device such as a tablet, a smartwatch, a laptop, a smart hub, etc. The smartphone 636 may include or run an application ("app") that allows a user to select from one or more predefined colors, predefined patterns, etc. for a fiber or fabric. In another example, the app on the smartphone 636 may allow the user to design a custom pattern. The smartphone 636 may then communicate with the controller 610 responsible for controlling the fiber/fabric, such as by wirelessly transmitting a signal to the transceiver 616 associated with the controller 610, after which electrical current may be provided to one or more fibers to effect the color change and/or pattern change of the color-changing product 400 as discussed in more detail herein.

As an example, an article of clothing or another product incorporating color-changing fibers may normally exhibit a first color or first pattern in a first state (e.g., the state 306), and a user may select a second, different color or pattern using the input device 630 (e.g., by pressing the button 632, swiping across the touch-sensitive portion 634, selecting an appropriate command on the smartphone 636, etc.), which in turn sends a signal to the controller 610 to turn the color-changing fabric 300 from the first color/pattern to the second color/pattern such that the color-changing fabric 300 is in a second state (e.g., the state 308) that differs from the first state (see, e.g., FIGS. 29 and 30). The input device 630 may therefore allow the user to determine when a color change occurs and/or what pattern appears on the color-changing product 400.

As shown in FIG. 31, in some embodiments, the color-changing product 400 and/or the control system 600 include one or more sensors (e.g., sensors to measure temperature, force, pressure, acceleration, moisture, motion, activity, occupancy, proximity, health characteristics, gas, liquid, chemicals, light, etc.), shown as sensors 494 and/or sensors 640. The sensors 494 and/or the sensors 640 may be configured to (i) monitor various characteristics and/or parameters and (ii) send signals to the controller 610 regarding the characteristics and/or parameters to facilitate determining if and/or when the color-changing product 400 should be activated (e.g., automatically based on the characteristics and/or parameters, etc.). The sensors 494 may be integrated into the color-changing fibers 10 and/or otherwise integrated into the color-changing product 400 (e.g., during manufacture of the color-changing product 400, etc.). The sensors 640 may be integrated into the controller 610 and/or electrically coupled thereto, and coupled to a portion of the color-changing product 400 post-manufacture.

In some embodiments, the sensors 494 and/or the sensors 640 include a piezoelectric sensor that is configured to sense a depressive force or pressure on the color-changing fabric 300 (e.g., similar to the touch-sensitive portion 634 in FIG. 36, etc.). The piezoelectric sensor may be incorporated directly into the color-changing fabric 300 of the color-changing product 400 and/or in a patch coupled to the color-changing fabric 300 of the color-changing product 400. The piezoelectric sensor may send an electrical signal to the controller 610 in response to detecting a depressive force and the controller 610 may take an appropriate action in response to the signal (e.g., command the power supply 620 to provide electrical current to the color-changing fibers 10 to activate the thermochromic pigments to transition the color, pattern, etc.).

In some embodiments, the sensors 494 and/or the sensors 640 include a hazard sensor configured to facilitate detecting a hazardous substance such as one or more specific gasses, liquids, and/or chemicals. By way of example, in a personal protective equipment embodiment (e.g., a lab coat, a hazmat suit, medical scrubs, gloves, military gear, etc.), the color-changing product 400 may include such a hazard sensor that is configured to detect harmful gasses in the ambient air around the color-changing product 400, harmful liquids that come into contact with the color-changing product 400, and/or harmful chemicals that come into contact with the color-changing product 400. In such embodiments, the controller 610 may (i) receive a signal from the hazard sensor when it detects a harmful substance and (ii) activate the color-changing product 400 to notify the wearer of the color-changing product 400 and/or people nearby. Such activation may include changing the color of the entire color-changing product 400, changing the color of the portion of the color-changing product 400 where the harmful substance was detected on the color-changing product 400, changing a pattern on the color-changing product 400 to a predefined warning pattern, dynamically changing the pattern, flashing the pattern, and/or still otherwise change the appearance of the color-changing product 400 to provide a warning notification.

In some embodiments, the sensors 494 and/or the sensors 640 include a light sensor configured to facilitate detecting a level of ambient light around the color-changing product 400. In such embodiments, the controller 610 may (i) receive a signal from the light sensor regarding light intensity and (ii) activate the color-changing product 400 in response to the light intensity falling below a threshold light intensity (e.g., when it gets relatively dark outside, a low light condition, etc.) and deactivate the color-changing product 400 in response to the light intensity exceeding the threshold light intensity.

In some embodiments, the sensors 494 and/or the sensors 640 include an activity or health sensor configured to facilitate monitoring physiological characteristics of the wearer of the color-changing product 400. By way of example, the physiological characteristics may include a heart rate, breathing patterns, temperature, sleeplessness/alertness, time of activity, $SpO_2$ levels, glucose levels, salt levels, hydration levels, and/or other physiological characteristics that may be affected by physical exertion. Such an activity or health sensor may be or include a heart rate sensor, a temperature sensor, a sweat sensor, a timer, a respiratory or breathing sensor, and/or still other sensors, to acquire the physiological characteristics regarding conditions of the wearer of the color-changing product 400. In such embodiments, the controller 610 may (i) receive a signal from the activity or health sensor regarding one or more physiological characteristics of the wearer of the color-changing product 400 and (ii) activate the color-changing product 400 in response to a physiological characteristic of the wearer not satisfying a corresponding physiological threshold (e.g., exceeding a threshold; falling below a threshold; a maximum heart rate, a minimum heart rate, a maximum time of activity, an irregular heartbeat, an irregular breathing pattern, a maximum temperature, a minimum temperature, a minimum glucose level, a maximum glucose level, a minimum salt level, a maximum salt level, etc.) to notify the wearer of the color-changing product 400 and/or people nearby. Such activation may include changing the color of the entire color-changing product 400, changing the color of a portion of the color-changing product 400, changing a pattern on the color-changing product 400 to a predefined warning pattern, flashing the pattern, and/or still otherwise change the appearance of the color-changing product 400 to provide a warning notification.

In some embodiments, the sensors 494 and/or the sensors 640 include an audio sensor (e.g., a microphone, a micro-electro-mechanical systems ("MEMS") microphone, etc.) configured to facilitate detecting sound waves. In some embodiments, the audio sensor is integrated into the input device 630. By way of example, the color-changing product 400 (or the input device 630) may include an audio sensor that is configured to detect voice commands. In such embodiments, the controller 610 may (i) receive a signal from the audio sensor when the audio sensor detects a voice command and (ii) activate the color-changing product 400 based on the voice command. Such activation may be specific to the voice command. For example, a first voice command (e.g., "active mode 1," etc.) may activate a first color, activate a first pattern, cause the pattern to flash/blink at a first rate, activate a first portion, etc.; while a second voice command (e.g., "active mode 2," etc.) may activate a second color, activate a second pattern, cause the pattern to flash/blink at a second rate, activate a second portion, etc.

In some embodiments, the sensors 494 and/or the sensors 640 include an activity sensor (e.g., a motion sensor, a proximity sensor, an occupancy sensor, etc.) configured to facilitate detecting a person and/or movement around the color-changing product 400. In some embodiments, the activity sensor is integrated into the color-changing product 400. In some embodiments, the activity sensor is an external sensor that is electrically connected to the color-changing product 400. The controller 610 may (i) receive a signal from the activity sensor when the activity sensor detects a person and/or movement and (ii) activate the color-changing product 400 based on the detection. By way of example, the controller 610 may be configured to activate the color-changing product 400 when a person enters a room or comes into a certain proximity and deactivate the color-changing product 400 when the person exits the room or is outside of the certain proximity.

In some embodiments, the controller 610 is configured to provide notifications to the wearer of the color-changing product 400 based on certain programmed activation settings. By way of example, the controller 610 may be wirelessly connected (e.g., via Bluetooth, etc.) to the wearer's personal device (e.g., smartphone, smartwatch, etc.). The controller 610 may be configured to activate the color-changing product 400 in response to the wearer's personal device generating a notification (e.g., a phone call notification, a text notification, an email notification, a social media notification, an alarm notification, a calendar notification, etc.). Such activation may include changing the color of the entire color-changing product 400, changing the color of a portion of the color-changing product 400, changing a pattern on the color-changing product 400 to a predefined notification pattern, flashing the pattern at a predefined frequency, and/or still otherwise change the appearance of the color-changing product 400 to provide a notification. The activation color, pattern, flashing frequency, and/or location for a first type of notification (e.g., a text message, etc.) may be different than the activation color, pattern, flashing frequency, and/or location for a second, different type of notification (e.g., an email, etc.).

The controller 610 may additionally or alternatively be configured to activate the color-changing product 400 based on data available on the wearer's personal device. The wearer's personal device may run or operate numerous applications such as a weather application, a maps application, etc. By way of example, the controller 610 may be configured to activate the color-changing product 400 or a portion thereof based on the data in the weather application indicating characteristics regarding the current weather (e.g., sunny, rain, snow, fog, hot, cold, etc.). For example, the controller 610 may be configured to activate a first color, activate a first pattern, cause the pattern to flash/blink at a first rate, activate a first portion, etc. based on a first weather characteristic; while the controller 610 may be configured to activate a second color, activate a second pattern, cause the pattern to flash/blink at a second rate, activate a second portion, etc. based on a second weather characteristic.

By way of another example, the controller 610 may be configured to activate the color-changing product 400 or a portion thereof based on the data in the maps application indicating directions to a destination during a GPS session (e.g., turn left, turn right, continue straight, arrived, etc.). For example, the controller 610 may be configured to activate a first color, a first pattern, cause the pattern to flash/blink at a first rate, activate a first portion (e.g., a right sleeve, etc.), etc. based on a first direction characteristic (e.g., turn right, etc.); while the controller 610 may be configured to activate a second color, activate a second pattern, cause the pattern to flash/blink at a second rate, activate a second portion (e.g., a left sleeve, etc.), etc. based on a second direction characteristics (e.g., turn left, etc.).

Figure 38:
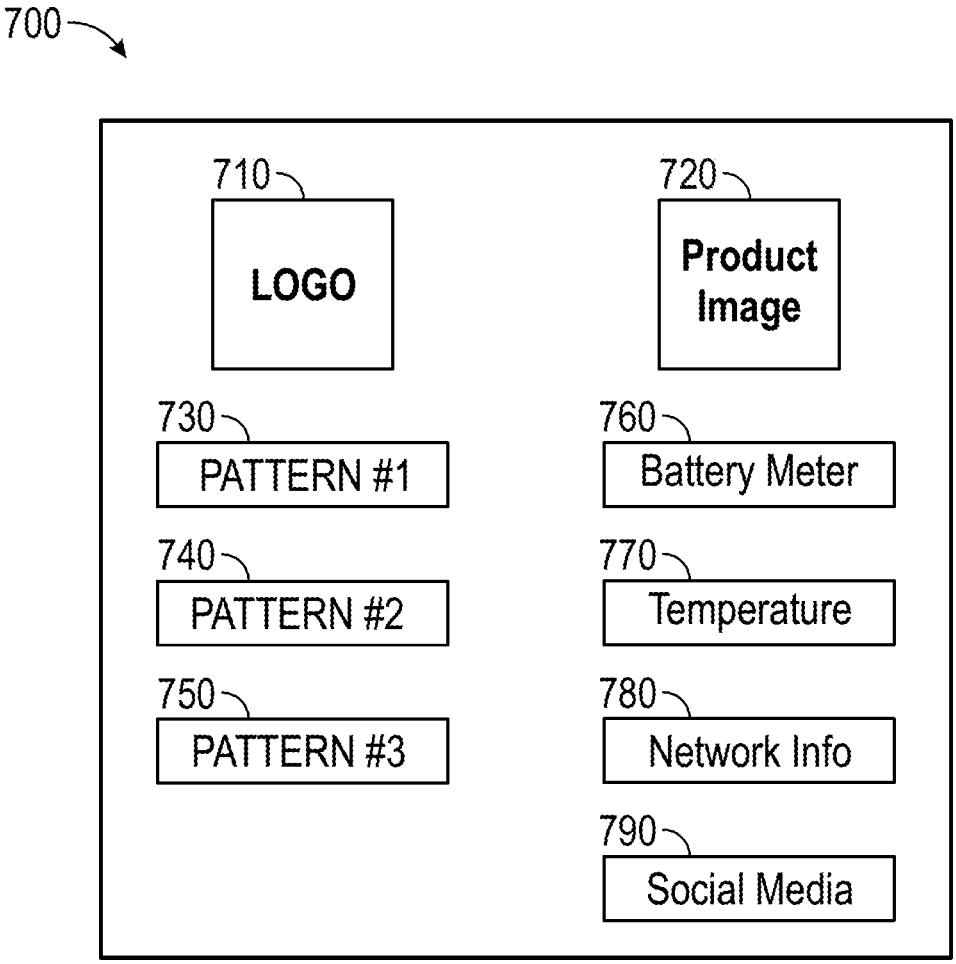
FIG. 38 is a schematic diagram of a graphical user interface of an application provided by an input device, according to an exemplary embodiment.

According to the exemplary embodiment shown in FIG. 38, a graphical user interface, shown as GUI 700, is provided to a user via the input device 630 (e.g., on a display thereof, etc.) through an app stored thereon or a program accessed thereby. As shown in FIG. 38, the GUI 700 has a logo button 710, a product image section 720, a first pattern button 730, a second pattern button 740, a third pattern button 750, a battery meter button 760, a temperature button 770, a network information button 780, and a social media button 790. In other embodiments, the GUI 700 provides more, fewer, or different buttons or sections. The logo button 710 may facilitate selectively manipulating the visual appearance (e.g., color, pattern, etc.) of a logo or embroidered portion (e.g., using the color-changing fiber 10, etc.) of the color-changing product 400. The product image section 720 may visually depict how the color-changing product 400 currently looks or provide a visual rendering of what the color-changing product 400 may look like following confirmation of a command to change a color and/or a pattern of the color-changing product 400 (e.g., via the logo button 710, the first pattern button 730, the second pattern button 740, the third pattern button 750, etc.).

The first pattern button 730, the second pattern button 740, and/or the third pattern button 750 may facilitate selectively manipulating the color and/or pattern of the color-changing product 400. By way of example, the first pattern button 730 may be associated with a first predefined pattern (e.g., a striped pattern, a checkered pattern, a first camouflage pattern, etc.), the second pattern button 740 may be associated with a second predefined pattern (e.g., a gradient color pattern, a second camouflage pattern, etc.), and the third pattern button 750 may be associated with a third predefined pattern (e.g., a solid color pattern, a third camouflage pattern, etc.). In some embodiments, the patterns associated with the first pattern button 730, the second pattern button 740, and/or the third pattern button 750 are selectively set by the user (e.g., downloadable, chosen from a larger list, etc.) and/or selectively customizable. In some embodiments, the GUI 700 provides fewer or more than three pattern options (e.g., two, four, five, etc. selectable patterns).

In some embodiments, the GUI 700 additionally or alternatively provides a notification button that facilitates defining which types of notifications cause activation of the color-changing product 400 and/or selecting what color, pattern, flash/blink rate, portion of the color-changing product 400, etc. is activated based on a respective type of notification.

The battery meter button 760 may facilitate selectively presenting a battery status or power level of the power supply 620 or the PV source 492 to the user of the input device 630 (e.g., upon selection by the user, etc.). The temperature button 770 may facilitate selectively presenting a temperature setting and/or a current temperature of the color-changing product 400 or various individual portions thereof to the user of the input device 630 (e.g., upon selection by the user, etc.). The network information button 780 may facilitate (i) selectively connecting the input device 630 to a respective color-changing product 400 (i.e., the controller 610 thereof) and/or (ii) selectively presenting network connection information to the user of the input device 630 (e.g., upon selection by the user, etc.) regarding communication between (a) the input device 630 and (b) the controller 610 (e.g., communication protocol type, connection strength, an identifier of the color-changing product 400 connected to the input device 630, etc.) and/or an external network (e.g., communication protocol type, connection strength, etc.). The social media button 790 may facilitate linking the app on the input device 630 to the user's social media account(s) (e.g., Facebook, Instagram, Snapchat, Twitter, etc.). Such linking may allow the user to share the patterns they have generated with their peers and/or facilitate downloading patterns generated by others via their social media account.

These examples are not intended as limiting but are provided merely to provide certain non-exclusive examples of how fabrics incorporating the color-changing fibers 10 disclosed herein may be controlled by a user. It should be noted that although the aforementioned examples contemplate the use of a wireless electronic device such as a smartphone to communicate with and change the color and/or pattern of a fabric and/or an individual fiber, any of a variety of other types of controllers may be used to control the color and/or pattern of a fabric, and may employ wired or wireless communications connections, and may use any useful wired or wireless communications protocols that are now known or that may be hereafter developed. The color and/or pattern changes may be manually activated at a desired time by a user or may be programmed to occur (or not occur) at defined times and/or intervals in the future. In some embodiments, the controller 610 is configured to activate at least a portion of the color-changing fibers 10 in response to the smartphone receiving a notification (e.g., a text message, an email, a call, etc.). The type of activation (e.g., color, pattern, etc.) or portion of the color-changing product 400 that is activated may correspond with the type of notification or the cause of such notification (e.g., the person texting, emailing, calling, etc.). The controller 610 may allow for programming of such timer settings and/or notifications using any of a variety of possible programming methods, all of which are intended to fall within the scope of the present disclosure.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X; Y; Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the fibers, yarns, fabrics, and end products as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

The invention claimed is:

1. A camouflage product comprising:

a fabric including:

a base layer arranged using a plurality of color-changing fibers, each of the plurality of color-changing fibers including:

an electrically conductive core; and a coating disposed around and along the electrically conductive core, the coating including a polymeric material having a first color-changing pigment; and a pattern layer printed onto the base layer, the pattern layer including a second color-changing pigment and providing a camouflage pattern along the base layer;

a connection bus disposed along at least a portion of the fabric, the connection bus forming a weld between the electrically conductive cores of the plurality of color-changing fibers, the connection bus including:

a connection layer manufactured from a metallic material that electrically connects the electrically conductive cores; and a sealing layer that electrically isolates the weld from a surrounding environment;

a power source electrically connected to the connection bus; and a controller configured to selectively activate the power source to provide an electrical current to the connection bus and, thereby, the electrically conductive cores to activate the first color-changing pigment and the second color-changing pigment to transition the camouflage pattern from a first camouflage pattern to a second camouflage pattern different than the first camouflage pattern.

2. The camouflage product of claim 1, wherein the connection bus includes a canvas layer positioned on top of the connection layer and the sealing layer.

3. The camouflage product of claim 1, wherein the first camouflage pattern has a first brightness and the second camouflage pattern has a second brightness different than the first brightness.

4. The camouflage product of claim 1, wherein the first camouflage pattern has a first camouflage design and the second camouflage pattern has a second camouflage design different than the first camouflage design.

5. The camouflage product of claim 1, wherein the pattern layer includes a first portion and a second portion, wherein the first portion includes the second thermochromic pigment and the second portion does not include a corresponding thermochromic pigment.

6. The camouflage product of claim 1, wherein the pattern layer includes a first portion and a second portion, and wherein the first portion includes the second thermochromic pigment and the second portion includes a third thermochromic pigment different than the second thermochromic pigment.

7. A color-changing product comprising:

a fabric including:

a base layer arranged using a plurality of color-changing fibers, each of the plurality of color-changing fibers including:

an electrically conductive core; and a coating disposed around and along the electrically conductive core, the coating including a polymeric material having a first thermochromic pigment; and a pattern layer printed onto the base layer, the pattern layer including a second thermochromic pigment and providing a pattern along the base layer;

a connection bus disposed along at least a portion of the fabric, the connection bus forming a weld between the electrically conductive cores of the plurality of color-changing fibers;

a power source electrically connected to the connection bus; and a controller configured to selectively activate the power source to provide an electrical current to the connection bus and, thereby, the electrically conductive cores to activate the first thermochromic pigment and the second thermochromic pigment to transition the pattern from a first state to a second state different than the first state.

8. The color-changing product of claim 7, wherein the first state is a camouflage pattern having a first brightness and the second state is the camouflage pattern having a second brightness.

9. The color-changing product of claim 7, wherein the first state is a first camouflage pattern and the second state is a second camouflage pattern different that the first camouflage pattern.

10. The color-changing product of claim 7, wherein the pattern layer includes a first portion and a second portion, wherein the first portion includes the second thermochromic pigment and the second portion does not include the second thermochromic pigment.

11. The color-changing product of claim 10, wherein the second portion includes a non-color-changing pigment.

12. The color-changing product of claim 10, wherein the second portion includes no pigment, thereby, exposing the base layer.

13. The color-changing product of claim 7, wherein the pattern layer includes a first portion and a second portion, and wherein the first portion includes the second thermochromic pigment and the second portion includes a third thermochromic pigment different than the second thermochromic pigment.

14. The color-changing product of claim 7, wherein the base layer includes at least one non-color changing fiber that is a natural fiber or a synthetic fiber that does not include the electrically conductive core and the coating.

15. The color-changing product of claim 7, wherein the electrically conductive core has a first tensile strength, wherein each of the plurality of color-changing fibers includes a reinforcement core disposed within the coating, and wherein the reinforcement core has a second tensile strength that is greater than the first tensile strength.

16. The color-changing product of claim 7, wherein the connection bus includes:

a connection layer manufactured from a metallic material that electrically connects the electrically conductive cores; and a sealing layer that electrically isolates the weld from a surrounding environment.

17. The color-changing product of claim 16, wherein the connection bus includes a canvas layer positioned on top of the connection layer and the sealing layer.

18. The color-changing product of claim 7, wherein the connection bus includes a plurality of separate connection busses positioned along the fabric to provide a plurality of groupings of welded fibers.

19. The color-changing product of claim 7, wherein the connection bus is a single connection bus extending continuously along a length of the fabric.

20. A color-changing product comprising:

a fabric including:

a base layer arranged using a plurality of color-changing fibers, each of the plurality of color-changing fibers including:

an electrically conductive core; and a coating disposed around and along the electrically conductive core, the coating including a first thermochromic pigment; and a pattern layer disposed on the base layer, the pattern layer including a second thermochromic pigment and providing a pattern along the base layer; and a connection bus disposed along at least a portion of the fabric, the connection bus forming a weld between the electrically conductive cores of the plurality of color-changing fibers, wherein the first thermochromic pigment and the second thermochromic pigment are activatable by providing an electric current to the connection bus to transition the pattern from a first state to a second state different than the first state.

* * * * *